US008205869B2

(12) United States Patent
Hosaka et al.

(10) Patent No.: US 8,205,869 B2
(45) Date of Patent: Jun. 26, 2012

(54) APPARATUS FOR CONVEYING SHEET

(75) Inventors: Rika Hosaka, Yokohama (JP); Koichi Ootomi, Kawasaki (JP); Masaki Takahashi, Yokohama (JP); Mitsunobu Yoshida, Kawasaki (JP); Misato Ishikawa, Yokohama (JP); Ena Ishii, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/038,657

(22) Filed: Mar. 2, 2011

(65) Prior Publication Data

US 2011/0169214 A1 Jul. 14, 2011

Related U.S. Application Data

(63) Continuation of application No. PCT/JP2009/065361, filed on Sep. 2, 2009.

(30) Foreign Application Priority Data

Sep. 2, 2008 (JP) ..... 2008-225320
Sep. 2, 2008 (JP) ..... 2008-225321
Sep. 2, 2008 (JP) ..... 2008-225322

(51) Int. Cl.
*B65H 83/00* (2006.01)

(52) U.S. Cl. ..... 271/3.14; 271/8.1; 271/264

(58) Field of Classification Search ..... 271/3.14, 271/8.1, 264
See application file for complete search history.

(56) References Cited

U.S. PATENT DOCUMENTS 5,864,735 A * 1/1999 Fukuda et al. ..... 399/139

FOREIGN PATENT DOCUMENTS

| | | |
|---|---|---|
| JP | 63-278882 | 11/1988 |
| JP | 09-171281 | 6/1997 |
| JP | 10-147034 | 6/1998 |
| JP | 2003-118888 | 4/2003 |
| JP | 2004-051275 | 2/2004 |
| JP | 2005-255354 | 9/2005 |
| JP | 2006-248650 | 9/2006 |
| JP | 2007-045609 | 2/2007 |

OTHER PUBLICATIONS

International Search Report for PCT/JP2009/065361 Mailed Nov. 17, 2009.

Richard H. Lyon, "Designing for Product Sound Quality", Marcel Dekker, Inc., New York, 2001.

* cited by examiner

*Primary Examiner* — Michael McCullough
(74) *Attorney, Agent, or Firm* — Turocy & Watson, LLP

(57) ABSTRACT

A sheet conveying apparatus includes a conveying mechanism and a control unit. The conveying mechanism is configured to pick up and convey a sheet every first time interval T and includes a sound source which produces a plurality of element sounds attendant on conveying the sheet. The control unit is configured to control the conveying mechanism so that the element sounds are caused at times determined based on a second time interval. The second time interval is acquired by dividing the first time interval T by a division number n which is an integer of two or more.

19 Claims, 26 Drawing Sheets

| | | |
|---|---|---|
| Solenoid power-on | Solenoid 306 | Non-eliminable |
| Solenoid power-off | Solenoid 306 | Ignorably small |
| Clutch power-on | Clutches 304 / 305 | Non-eliminable |
| Clutch power-off | Clutches 304 / 305 | Ignorably small |
| Pickup roller 1a collides against sheet 10 | Pickup roller 1a | Non-eliminable |
| Collision of mechanism when pickup roller 1a returns | Pickup roller 1a | Non-eliminable |
| Sound of collision of sheet 10 against sheet feeding roller 2a | Sheet feeding roller 2a | Eliminable below ignorable level (no sound is caused if mechanism in which pickup roller 1a and paper feed roller 2a are linked by belt and rotate at the same speed) |
| Sound of collision of sheet against conveying roller 3a | Conveying roller 3a | Eliminable below ignorable level |
| Sound of collision of sheet against registration roller 4 | Registration roller 4 | Non-eliminable in terms of role played by registration roller |
| Sound caused when flexed sheet 10 is stretched | Between sheet feeding roller 2a and conveying roller 3a | Eliminable below ignorable level (prevent flexure from arising) |
| Sound caused when flexed sheet 10 is stretched | Between conveying roller 3a and registration roller 4 | Eliminable below ignorable level (control to gradually stretch flexure) |
| Caused when sheet 10 is pulled faster than rotational speed of roller 2a | Sheet feeding roller 2a | Eliminable below ignorable level |
| Caused when sheet 10 is pulled faster than rotational speed of roller 3a | Conveying roller 3a | Eliminable below ignorable level |

FIG. 9

| Sound element index | Sound element | Category (rhythm control/elimination control/ignore) |
|---|---|---|
| R1 | Solenoid power-on | Rhythm control |
| I1 | Solenoid power-off | Ignore |
| R2 | Clutch power-on | Rhythm control |
| I2 | Clutch power-off | Ignore |
| R3 | Sheet and pickup roller sound | Rhythm control |
| R4 | Pickup roller return | Rhythm control |
| D1 | Sheet and feeding roller | Elimination control below ignorable level |
| D2 | Sheet and conveying roller | Elimination control below ignorable level |
| R5 | Sheet registration sound | Rhythm control |
| D3 | Between sheet feeding roller and conveying roller | Elimination control below ignorable level |
| D4 | Between conveying roller and registration roller | Elimination control below ignorable level |
| D5 | Sheet feeding roller | Elimination control below ignorable level |
| D6 | Conveying roller | Elimination control below ignorable level |

FIG. 10

| Index | Conveyance period |
|---|---|
| 1 | 1 [s] |
| 2 | 2 [s] |
| 3 | 3 [s] |

| Impulsive sound index | Impulsive sound occurrence time |
|---|---|
| S1 | 0 [s] |
| S2 | 0.67 [s] |
| S3 | 1.33 [s] |

| Impulsive sound index | Sound element index | | |
|---|---|---|---|
| S1 | R1 | R2 | R3 |
| S2 | R4 | | |
| S3 | R5 | | |

| Constraint condition index | Constraint condition |
|---|---|
| C1 | R3 < R4 |
| C2 | R4 < R5 |
| C3 | R2 < R4 |
| C4 | R1 = R3 |

APPARATUS FOR CONVEYING SHEET

CROSS REFERENCE TO RELATED APPLICATIONS

This is a Continuation Application of PCT Application No. PCT/JP2009/065361, filed Sep. 2, 2009, which was published under PCT Article 21(2) in Japanese.

This application is based upon and claims the benefit of priority from Japanese Patent Applications No. 2008-225320, filed Sep. 2, 2008; No. 2008-225321, filed Sep. 2, 2008; and No. 2008-225322, filed Sep. 2, 2008; the entire contents of all of which are incorporated herein by reference.

FIELD

Embodiments described herein relate generally to a sheet conveying apparatus that conveys a sheet in an image forming apparatus such as a copying machine and printer.

BACKGROUND

The electrophotographic method that forms an electrostatic image (electrostatic latent image) on a photoconductor drum, visualizes the image by toner, and transfers the image to a sheet (or paper-like medium such as paper) is generally deemed to be mainstream for an image forming apparatus such as a copying machine and printer used in an office or the like. The inkjet method that forms an image by directly spraying ink droplets onto a sheet is mostly adopted for a relatively small printer such as a home-use printer. An image forming apparatus called a copying machine or printer to form an image includes a sheet conveying apparatus to convey a sheet to an image forming unit or to deliver a sheet on which an image is formed.

In an image forming apparatus including a sheet conveying apparatus, a sheet (or paper-like medium such as paper) is picked up from a sheet feeding cassette or manual sheet feeding tray and conveyed by the sheet conveying apparatus, and the inclination of the sheet is adjusted by a registration roller before the sheet is fed to an image forming position where an image is transferred to the sheet. When a sheet is fed to the image forming position, element sounds such as an operation sound of a pickup roller and conveying rollers, an operation sound caused when these rollers start to be driven from a stopped state, and a collision sound (impulsive sound) when a sheet collides against the registration roller are caused. Such element sounds are caused also by other components attendant on conveying a sheet and perceived as noise. Moreover, element sounds are repeated as many times as the number of sheets to be printed. An image forming apparatus is mostly installed in an office environment or the like and an influence of noise spreads not only to the user of the apparatus, but also to workers therearound. If irregular impulsive sounds are caused frequently, it is annoying for the user of the apparatus and workers therearound and operating efficiency could adversely be affected.

In a conventional sheet conveying apparatus, various ideas to reduce such noise are implemented. For example, JP-A 2003-118888 (KOKAI) and JP-A 2006-248650 (KOKAI) disclose sheet conveying apparatuses that reduce an impulsive sound caused when a sheet is carried out of a sheet feeding cassette. However, even if measures against noise are taken, reducing the noise level to an audible level or below is deemed to be realistically impossible. Thus, it is difficult to eliminate annoyance to the user of the apparatus and workers therearound.

"Designing for Product Sound Quality", Richard H Lyon, p. 1-10, June 2000, on the other hand, proposes product sound quality (PSQ) that considers a working sound arising from a product not as noise, but as a sound and enhances product value by designing a product sound. Instead of minimizing the noise level by considering a working sound of a product simply as noise, this idea designs sound as a portion of the product.

While conventional sheet conveying apparatuses disclosed by JP-A 2003-118888 (KOKAI) and JP-A 2006-248650 (KOKAI) can reduce the generated noise to some extent, there is a problem that noise cannot be completely got rid of, thus a sheet conveying apparatus capable of reducing annoyance caused by noise is demanded.

BRIEF DESCRIPTION OF THE DRAWINGS

FIG. 9 is a table listing sound elements shown as a sound element list, which are sound sources of the sheet conveying mechanism shown in FIG. 7.

FIG. 10 is a table showing a data format registered in a memory unit of a control device as the sound element list shown in FIG. 9.

DETAILED DESCRIPTION

In general, according to one embodiment, a sheet conveying apparatus include a conveying mechanism and a control unit. The conveying mechanism is configured to pick up and convey a sheet every first time interval T and includes a sound source which produces a plurality of element sounds attendant on conveying the sheet. The control unit is configured to control the conveying mechanism so that the element sounds are caused at times determined based on a second time interval. The second time interval is acquired by dividing the first time interval T by a division number n which is an integer of two or more.

Various embodiments will be described hereinafter with reference to the accompanying drawings.

Figure 1:
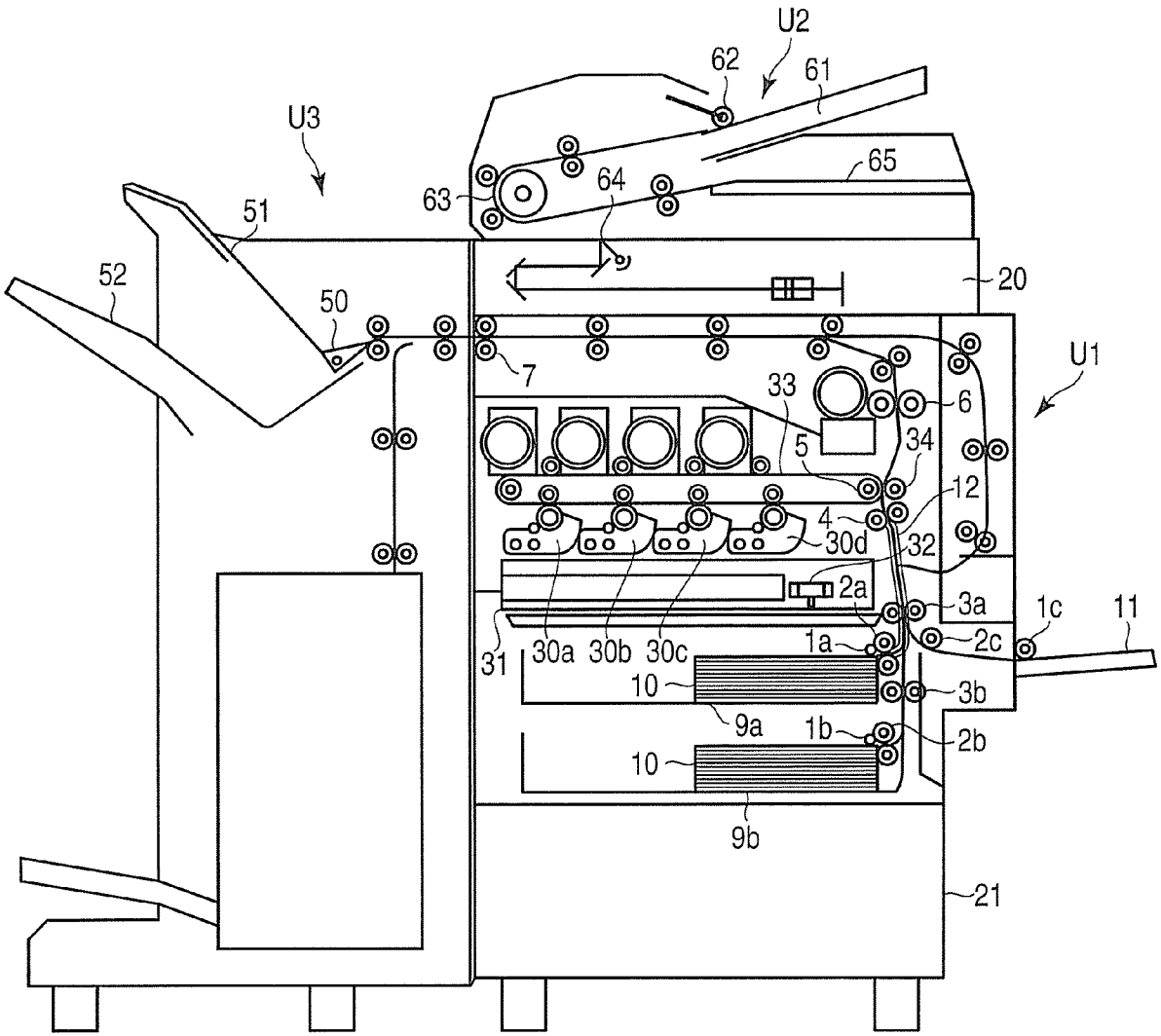
FIG. 1 is a schematic diagram showing an image forming apparatus including a sheet conveying apparatus according to one embodiment.

FIG. 1 schematically shows the configuration of a sheet conveying apparatus of a multi function peripheral (hereinafter, referred to as a MFP) using the electrophotographic method as a sheet conveying apparatus according to one embodiment. As shown in FIG. 1, the MFP includes a body unit U1 to transfer and form an image on a sheet, a manuscript conveying unit U2 to convey a manuscript to be copied to a manuscript reading apparatus 20 mounted inside the body unit U1, and a finisher unit U3 to sequentially stack sheets 10 on which an image has been formed by the body unit U1 or to do work to sort out the sheets 10 for each page.

The body unit U1 includes a photoconductor drum to the surface of which a photosensitive material whose conductivity changes by irradiation with a laser beam or the like is applied, a charging unit that uniformly charges the surface of the photoconductor drum, and process units 30*a*, 30*b*, 30*c*, and 30*d* constituted of a developing roller or the like to cause toner to selectively adhere to the photoconductor drum. Toner of yellow, magenta, cyan, and black is supplied to these process units 30*a*, 30*b*, 30*c*, and 30*d* to form single-color images in the process units 30*a*, 30*b*, 30*c*, and 30*d*, respectively.

In an optical unit 31, a laser diode (not shown) serving as a light source of a laser beam is provided. The laser beam output from the laser diode is modulated in accordance with an image to be formed, directed toward a polygon mirror 32, and reflected by the polygon mirror 32. Then, the surface of the uniformly charged photoconductor drum of each of the process units 30*a*, 30*b*, 30*c*, and 30*d* is scanned by the reflected laser beam to form an electrostatic latent image on the surface. That is, the laser diode is driven in accordance with information of an image to be formed and the laser beam is guided by a group of mirrors (not shown) and deflected on the surface of the process units 30*a*, 30*b*, 30*c*, and 30*d*. In this manner, exposures of the surface of the photoconductor drum are performed in accordance with the image information. On the surface of the photoconductor drum uniformly charged at several hundred volts, only the charging potential of a portion to which the laser beam has been exposed drops close to 0 V to form an electrostatic image (electrostatic latent image). The electrostatic latent image is developed into a visible image by toner on the surface of the developing roller to form a toner image on the surface of the photoconductor drum.

The single-color toner image formed in each of the process units 30*a*, 30*b*, 30*c*, and 30*d* is transferred to a transfer belt 33. The image forming timing of each of the process units 30*a*, 30*b*, 30*c*, and 30*d* is set in advance so that each single-color image is superimposed with a predetermined precision when transferred to the transfer belt 33. Accordingly, a full-color toner image is formed on the transfer belt 33.

The toner image on the transfer belt 33 is transferred to the sheet 10 conveyed by a sheet conveying mechanism, which is described later, in a secondary transfer unit 5. The transfer to the sheet 10 is carried out by applying a high-voltage bias to a secondary transfer roller 34 at a nip part where the transfer belt 33 and the secondary transfer roller 34 are in contact to electrically absorb toner on the surface of the sheet 10. The toner image transferred onto the sheet 10 only adheres to the sheet 10 in the form of powder with a feeble force in this state and could easily peel off from the surface of the sheet 10 so that the toner image is fixed in the next process. That is, the sheet 10 to which the toner image has been transferred is conveyed to a fixing roller pair 6 heated by a halogen heater or an electromagnetic heating system. When the sheet 10 is nipped between the fixing roller pair 6 and conveyed, the toner on the surface of the sheet 10 is melted due to heating/pressure and pressed against the surface of the sheet 10 by pressure before the toner image on the sheet 10 is fixed as a semi-permanent image.

A small amount of transfer residual toner adheres to the surfaces of the transfer belt 33 to which a toner image should be transferred and the photoconductor drum. Thus, the MFP shown in FIG. 1 includes a cleaning mechanism (not shown) and the surfaces of the transfer belt 33 and the photoconductor drum are cleaned by the cleaning mechanism to prepare for the next image formation.

In the MFP shown in FIG. 1, the image forming operation is continuously performed by repeating the operation described above.

Figure 2:
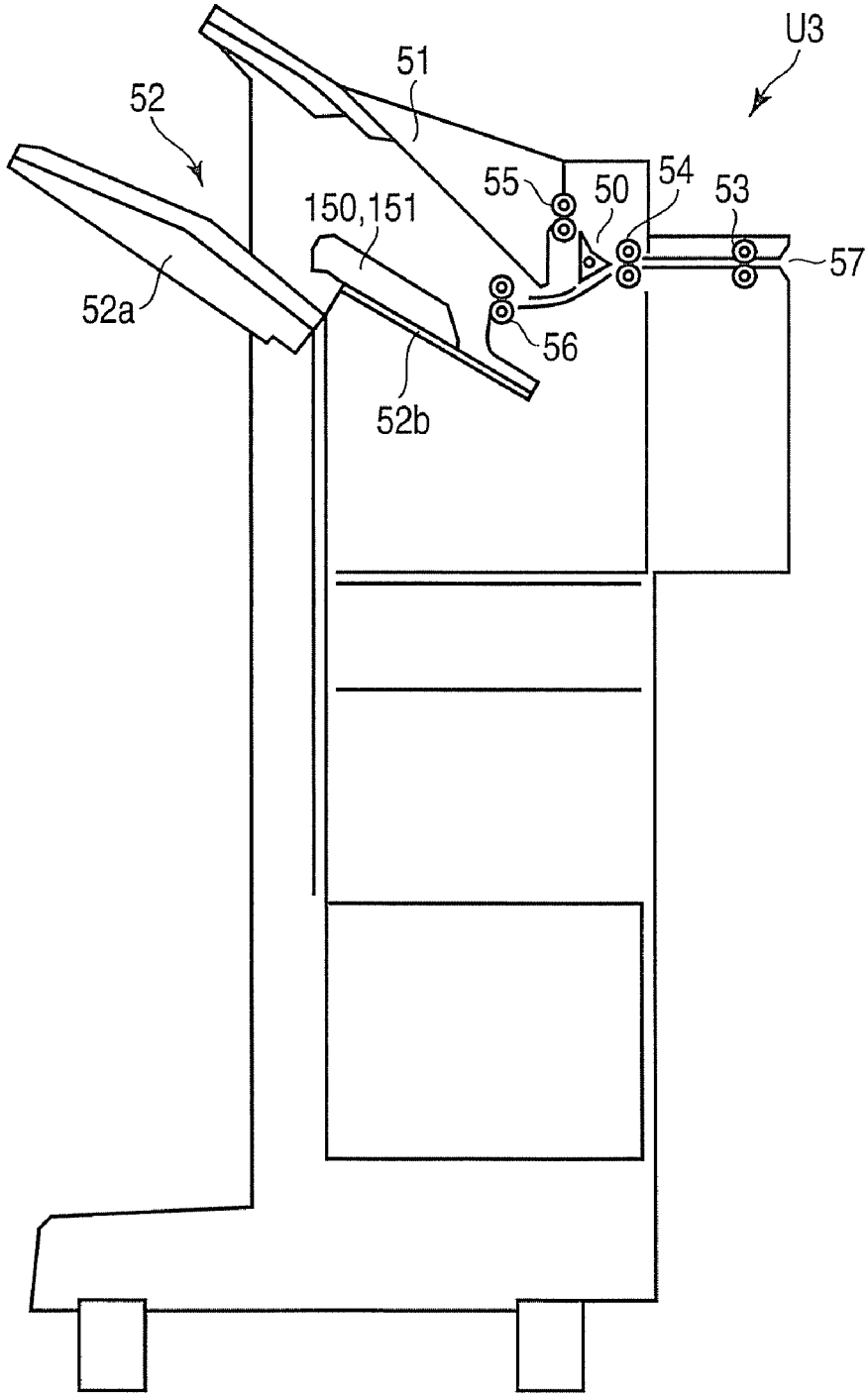
FIG. 2 is a schematic diagram showing a finisher unit shown in FIG. 1.
Figure 3:
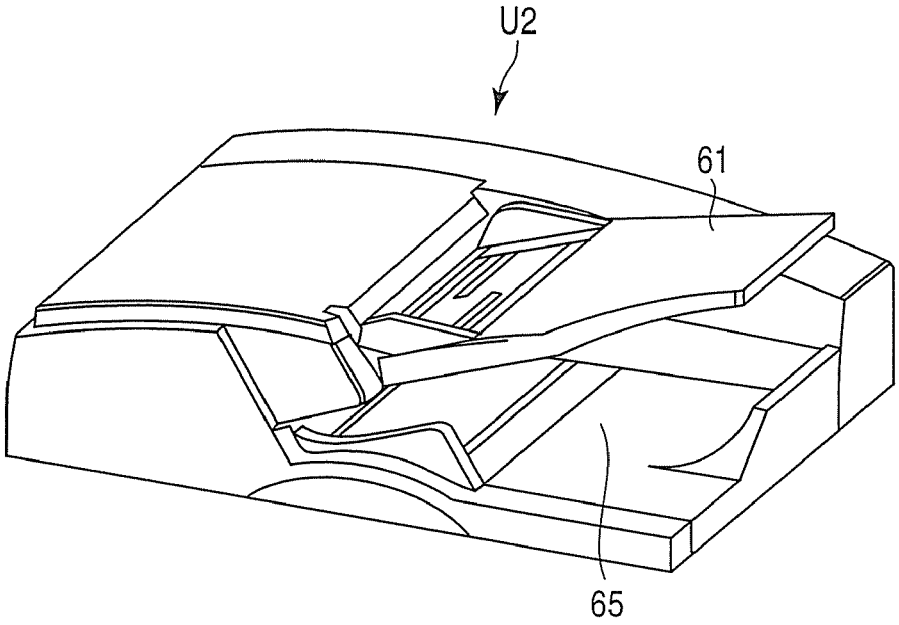
FIG. 3 is a perspective view showing a manuscript conveying unit shown in FIG. 1.
Figure 4:
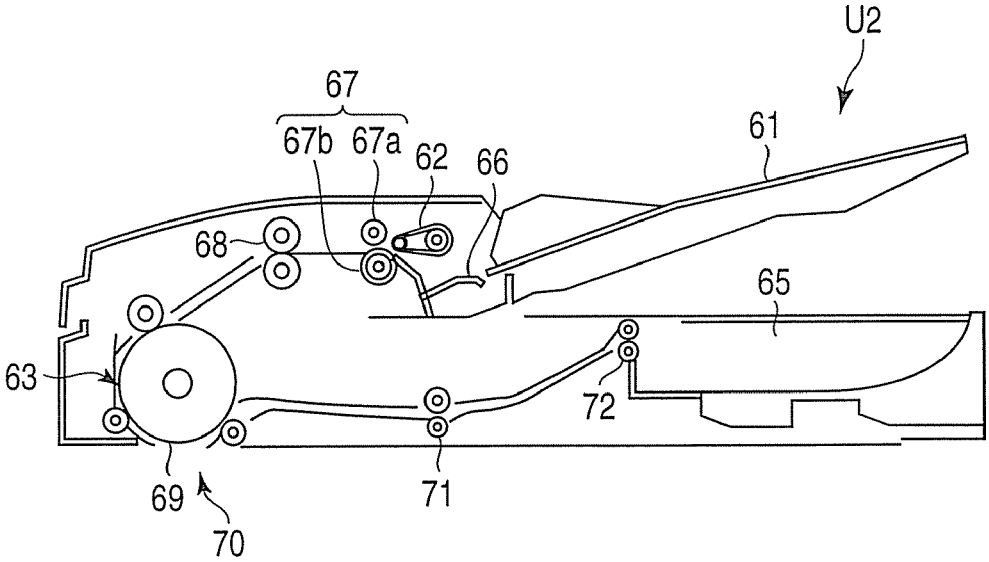
FIG. 4 is a schematic diagram showing the manuscript conveying unit shown in FIG. 1.

Next, a sheet conveyance operation in the MFP shown in FIG. 1 will be described with reference to FIGS. 1 to 4. FIG. 2 is a sectional view showing a more detailed configuration of the finisher unit U3 shown in FIG. 1. FIGS. 3 and 4 are a perspective view and a sectional view showing a more detailed configuration of the manuscript conveying unit U2 shown in FIG. 1, respectively.

In a housing 21 shown in FIG. 1, sheet feeding cassettes 9*a* and 9*b* to house the sheets 10 which are stacked and a manual sheet feeding tray 11 to feed the sheets 10 are provided. The sheet 10 is picked up from the sheet feeding cassette 9*a* or 9*b* by a pickup roller (also called a pickup unit) 1*a* or 1*b* and the sheets 10 is conveyed to a conveying path by sheet feeding roller pair (also called a sheet feeding unit) 2*a* or 2*b*. From the manual sheet feeding tray 11, the sheet 10 is picked up by a manual pickup roller 1*c* and then, similarly conveyed to the conveying path by a manual sheet feeding roller 2*c*.

The sheet 10 described herein means a paper-like medium such as paper on which an image is formed. The paper-like medium is not limited to media made of paper, and includes members such as sheets made of resin, metal or the like on which an image can be formed. The sheet 10 described herein includes such paper-like media.

The sheet 10 picked up from the sheet feeding cassette 9*a* is conveyed to a registration roller pair 4 along a conveying guide 12 that define the conveying path by an intermediate conveying roller pair (hereinafter, also referred to simply as a conveying roller pair) 3*a*. The sheet 10 picked up from the sheet feeding cassette 9*b* is first conveyed to the intermediate conveying roller pair 3*a* by an intermediate conveying roller pair 3*b* and then conveyed to the registration roller pair 4 along the conveying guide 12 by the intermediate conveying roller pair 3*a*.

The sheet 10 conveyed on the conveying path is made to abut the tip thereof against a nip part (contact part) of the registration roller pair 4 to correct the inclination of the sheet tip before being sent to the secondary transfer unit 5, which corresponds to an image forming unit, by the registration roller pair 4. In the secondary transfer unit 5, as described above, an image is transferred to the sheet 10 in accordance with image data. The image transferred to the sheet 10 is fixed to the sheet 10 by heating/pressure while being nipped between the fixing roller pair 6. The sheet 10 on which the image is formed is conveyed from the body unit U1 to the finisher unit U3 by a delivery roller pair 7 or the like.

Thus, the sheet 10 is picked up from the sheet feeding cassette 9*a* or 9*b* and delivered to the finisher unit U3 via the delivery roller pair 7 and therefore, the sheet feeding cassette 9*a* or 9*b* corresponds to the upstream side in the conveying path of the sheet 10 and the delivery roller pair 7 corresponds to the downstream side.

As shown in FIG. 2, the sheet 10 on which an image is formed by the body unit U1 is introduced from an entry 57 connected to the conveying path inside the body unit U1 and conveyed to the finisher unit U3 by conveying roller pairs 53 and 54. The finisher unit U3 includes finisher trays 51 and 52 in which the sheet 10 on which an image has been formed is piled up to deliver or discharge the sheet 10 out of the MPF. In the MFP shown in FIG. 1, as described later, an operation mode (also called operating conditions) is selected via a control panel 102 as an interface including an input unit and a display unit provided in the body unit U1 and the finisher tray 51 or 52 to which the sheet 10 is delivered is already decided. The sheet 10 on which an image has been formed is sorted out by a transfer gate 50 driven by a solenoid actuator (not shown) in accordance with the selected operation mode and conveyed to the finisher tray 51 by a conveying roller pair 55 or to the finisher tray 52 by a conveying roller pair 56. Particularly, when there is no need to sort out the sheets 10, the sheets 10 on which an image has been formed are sequentially piled up on the finisher tray 51. If sorting work such as sorting the sheets 10 into groups of the number of copies or aligning the sheets 10 is to be done, the sheets 10 on which an image has been formed is conveyed to the finisher tray 52. The finisher tray 52 is provided with sheet aligning paddles 150 and 151 to align the sheets 10 piled up thereon. Further, the finisher unit U3 includes a mechanism (not shown) to do sorting work to sort the sheets 10 into groups of the number of copies. In the finisher tray 52, the sheets 10 sequentially piled up on a sheet aligning unit 52*b* is nipped between the sheet aligning paddles 150 and 151 and aligned along the sheet aligning paddles 150 and 151, and then a bundle of sheets whose both ends are aligned is delivered or discharged to a stack unit 52*a* by a sheet conveying mechanism (not shown).

The sheet conveyance operation performed by the finisher unit U3 is controlled in synchronization with an image forming process by the body unit U1 to avoid a sheet jam when the sheet 10 is introduced from the body unit U1 to the finisher unit U3.

In the manuscript conveying unit U2 shown in FIG. 3, when a manuscript sheet (not shown) is placed on a manuscript tray 61, a detection sensor (not shown) detects that the manuscript sheet is housed on the manuscript tray 61. When the manuscript sheet is detected by the detection sensor and a command is input from the control panel 102 to start a copying operation, as shown in FIG. 4, a hoisting tray 66 moved up/down by a drive motor (not shown) is moved up and the manuscript sheet is pressed against a manuscript pickup roller 62. If the manuscript pickup roller 62 is rotated by a pickup roller drive motor (not shown) while the manuscript sheet is pressed against the manuscript pickup roller 62, the manuscript sheet is conveyed to a separation roller pair 67. The separation roller pair 67 includes a conveying roller 67*a* that makes a forward rotation in the conveyance direction and a reverse rotation roller 67*b* that rotates in a direction opposite to the rotation direction of the conveying roller 67*a*. When a plurality of manuscript sheets is conveyed to the separation roller pair 67 by the manuscript pickup roller 62 in a state in which the manuscript sheets are piled up, the manuscript sheets are separated into each sheet by the separation roller pair 67 and the topmost manuscript sheet is conveyed to a registration roller pair 68. The manuscript sheet picked up one by one after the separation is caused to collide against the registration roller pair 68 to align itself. The registration roller pair 68 has the same function as that of the registration roller pair 4 provided in the body unit U1. That is, the manuscript sheet is caused to collide against a nip part of the stopped registration roller pair 68 to correct the inclination of the manuscript sheet. When the tip of the manuscript sheet is caused to collide against the registration roller pair 68, the registration roller pair 68 is driven by a drive motor (not shown) and the manuscript sheet is conveyed to a manuscript reversal unit 63. In the manuscript reversal unit 63, the manuscript sheet is conveyed by a conveying roller 69 while the manuscript surface of the manuscript sheet is in contact with a manuscript glass surface 64, which is provided on the surface of the manuscript reading device 20 shown in FIG. 1, via an opening 70 provided below the conveying roller 69. In the manuscript reading apparatus 20, the manuscript surface of the manuscript sheet is shone by a light source lamp and a reflected light thereof is guided to a CCD line sensor (not shown) by a lens (not shown) to be converted into a image data signal. Based on the image data signal, as described above, an image is formed on the sheet 10 by the body unit U1. After passing through the manuscript reversal unit 63, the manuscript sheet is delivered to a manuscript delivery tray 65 by conveying roller pairs 71 and 72 to be sequentially piled up on the manuscript delivery tray 65.

Figure 5:
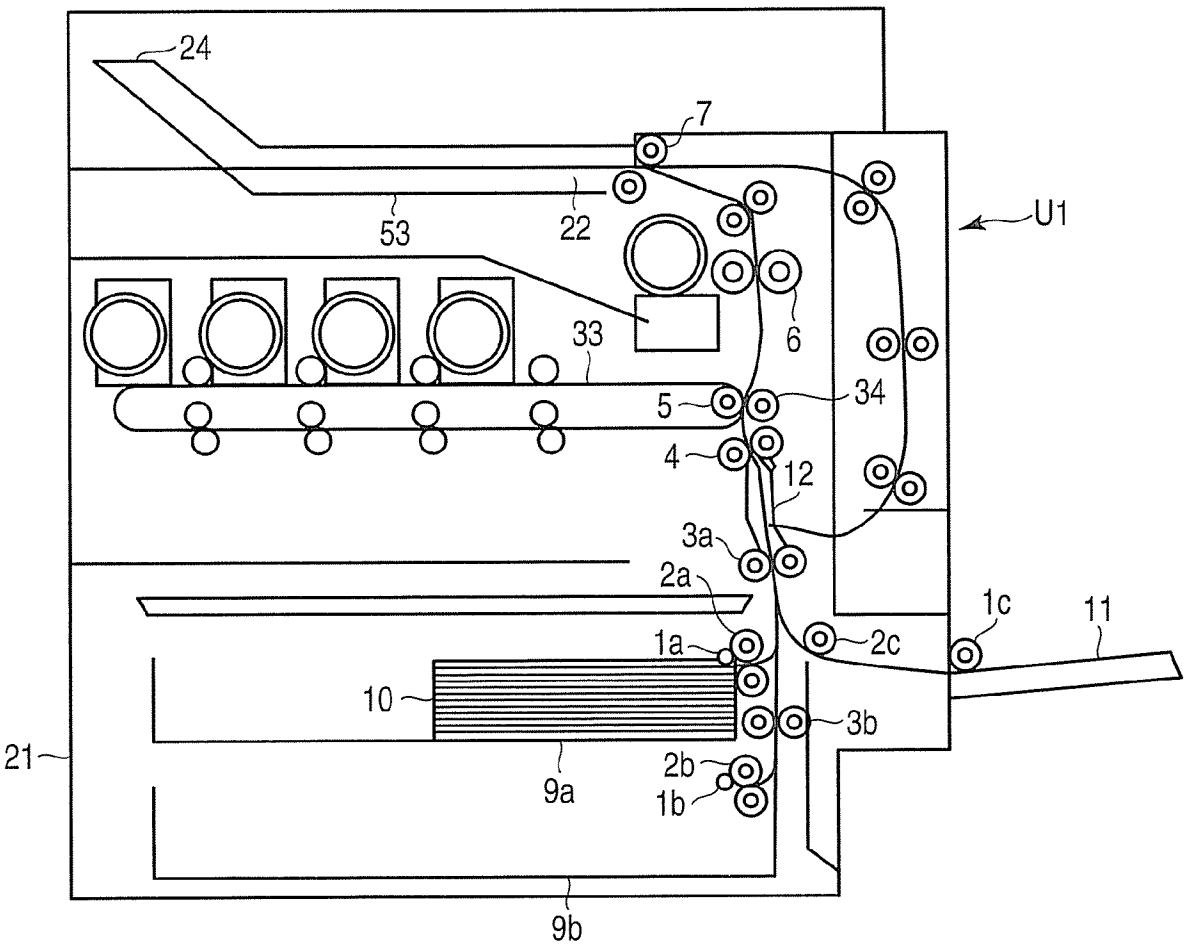
FIG. 5 is a schematic diagram showing an image forming apparatus including a sheet conveying apparatus according to another embodiment.

In a sheet conveying apparatus according to another embodiment, as shown in FIG. 5, instead of including the finisher unit U3, a finisher tray 53 including a discharging port 24 to discharge the sheet 10 out of the apparatus may be provided in the body unit U1. In this case, the delivery roller pair 7 is arranged immediately before an introduction port 22 to introduce the sheet 10 into the finisher tray 53. In FIG. 5, the same reference numerals are attached to the same portions or locations as those in FIG. 1 and a description thereof is omitted.

Figure 6:
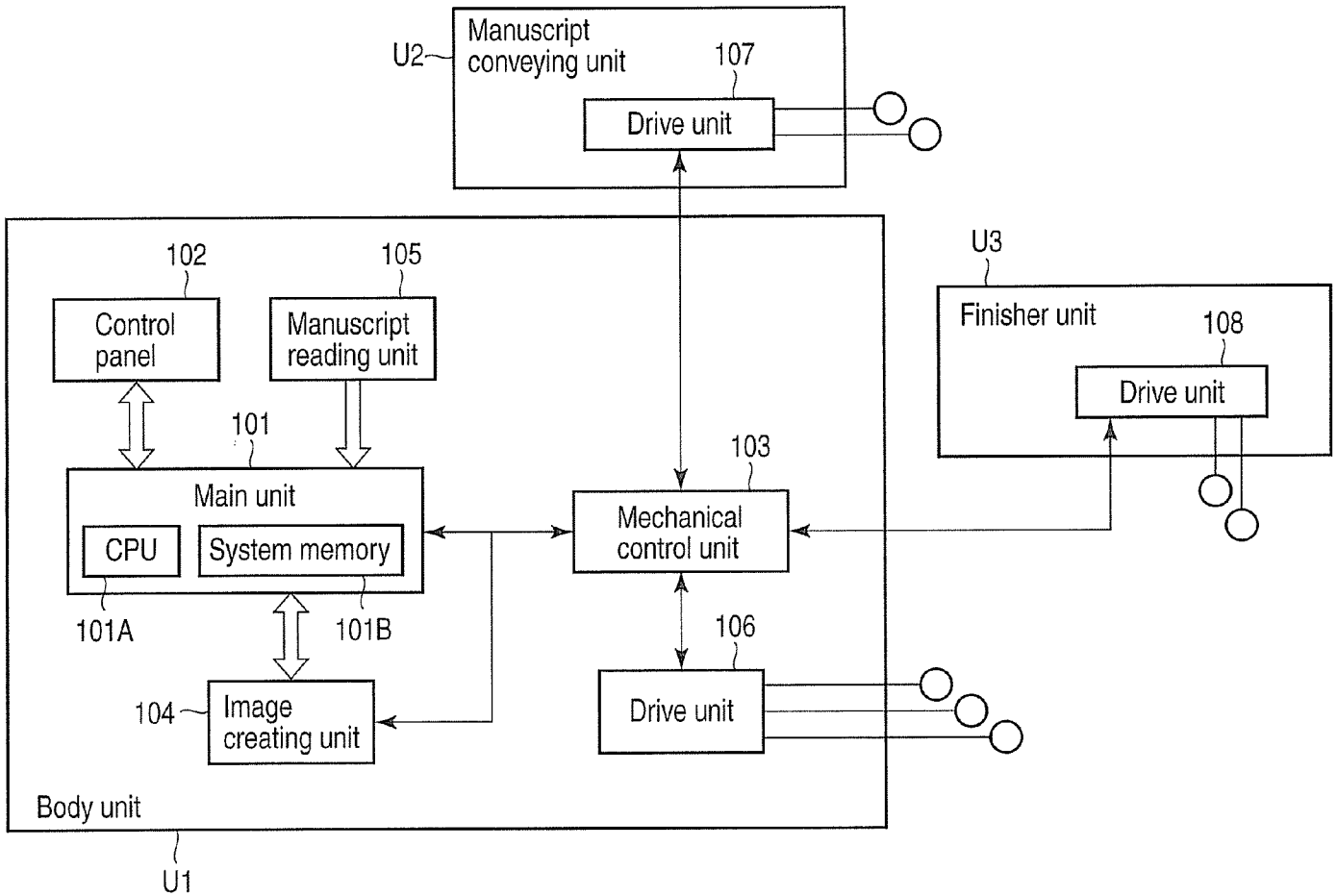
FIG. 6 is a block diagram showing a system circuit and a drive circuit of the sheet conveying apparatus shown in FIG. 1.

FIG. 6 schematically shows a system circuit and a drive circuit of the MFP shown in FIG. 1. A main unit (also called a control unit) 101 of the body unit U1 includes, as shown in FIG. 6, a CPU 101A that performs various kinds of signal processing and a system memory 101B that stores a sequence program to operate the MFP in advance. When a command of copying operation or the like is input into the control panel 102, the main unit 101 outputs a command signal in accordance with the input and a timing signal to a mechanical control unit 103. The mechanical control unit 103 is constituted of a circuit system that drives drive units 106, 107, and 108 provided in the respective units U1, U2, and U3. Each of the drive units 106, 107, and 108 includes a motor, solenoid, clutch and the like. The mechanical control unit 103 outputs a drive signal to the drive units 106, 107, and 108 of the respective units U1, U2, and U3 in accordance with the command signal and timing signal input from the main unit 101. Each of the drive units 106, 107, and 108 receives the drive signal and the motor, solenoid, and clutch of each of the drive units 106, 107, and 108 are driven in synchronization according to the timing signal from the main unit 101. The command signal and timing signal are also output to an image creating unit 104 and sheet conveyance and image formation are carried out together according to the command signal and timing signal to perform a series of operations described above.

In the image creating unit 104 denoted as a block in FIG. 6, components necessary for image formation such as a voltage source to apply various high-voltage biases to components to form an image and a drive circuit to output a drive signal in accordance with an image information signal of a manuscript read by a manuscript reading unit 105 are aggregated.

As described above, the body unit U1, the manuscript conveying unit U2, and the finisher unit U3 each have the sheet conveying mechanism. Generally, element sounds such as an impulsive sound are irregularly caused in a series of sheet conveying processes described above, and these element sounds are repeated as many times as the number of copies. In the embodiments, such element sounds are controlled to be caused regularly so as to be perceived by the user as a comfortable rhythm. An element sound described herein refers to a mechanical impulsive sound caused abruptly attendant on conveying the sheet 10. Elementary sounds will be described below while concretely mentioned as, for example, an impulsive sound, collision sound, and operation sound.

A sheet conveying apparatus described herein includes components necessary to convey the sheet 10. That is, the sheet conveying apparatus includes sheet conveying roller pairs to convey the sheet 10, drive motors to drive the sheet conveying roller pairs and the like, a driving force transmission mechanism, and a conveying guide to guide the sheet 10 during conveyance.

Also, the sheet conveying apparatus described herein refers to the whole apparatus including a sheet conveying mechanism, such as an MFP, an image forming apparatus, etc. As described above with reference to the MFP in FIG. 1, a series of operations such as image formation, sorting, and manuscript reading are performed in a combined operation with sheet conveyance. Thus, the apparatus itself including a sheet conveying mechanism, such as an MFP, can be viewed as a sheet conveying apparatus.

Next, the sheet conveying mechanism in the MFP shown in FIG. 1 will be described more concretely and also element sounds caused by each of the units U1, U2, and U3 will be described.

Figure 7:
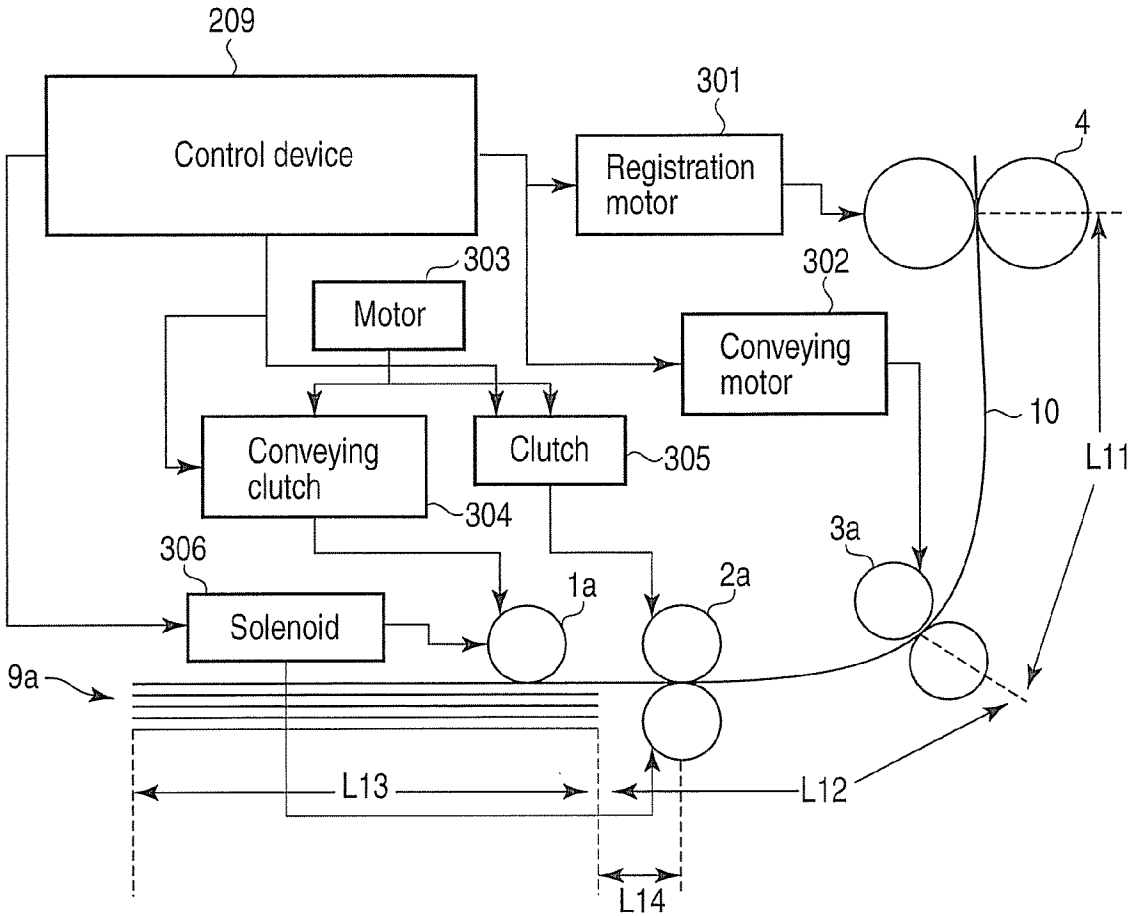
FIG. 7 is a block diagram more concretely showing an example of a sheet conveying mechanism from a sheet feeding cassette to a registration roller pair shown in FIG. 1.

FIG. 7 exemplifies a sheet conveying mechanism arranged on the conveying path from the sheet feeding cassette 9*a* to the registration roller pair 4 in the body unit U1 shown in FIG. 1. The control device 209 shown in FIG. 7 includes the main unit 101 and the mechanical control unit 103 shown in FIG. 6. The control device 209 may be implemented in an electric circuit, electronic circuit or the like or may be executed, as described later, as a program on a PC (Personal Computer), microcomputer or the like including an arithmetic unit.

A solenoid such as a solenoid 306, clutch such as clutches 304 and 305, and various rollers serving as sound sources that cause impulsive sounds in the sheet conveying mechanism ranging from the sheet feeding cassette 9*a* to the registration roller pair 4 are also provided in the conveying path ranging from the registration roller pair 4 to the finisher unit U3 shown in FIG. 1. Thus, assuming that a similar control method can be applied to these electric elements or mechanical elements as sources that cause impulsive sounds, a description thereof is omitted below. Various impulsive sounds are caused in the manuscript conveying unit U2 and a timing at which each impulsive sound is caused can be controlled also for these impulsive sounds by using a similar technique. Similarly, sound sources that cause similar impulsive sounds are provided on the conveying path on which the sheet 10 is fed from the manual pickup roller 1*c* to the intermediate conveying roller pair 3*a* via the manual sheet feeding roller 2*c* and a similar control method can be applied.

In the sheet conveying mechanism shown in FIG. 7, the pickup roller 1*a* to pick up one sheet 10 every sheet feed time interval from the sheet feeding cassette 9*a* is arranged above the sheets 10 and the sheets 10 are picked up one after another by the pickup roller 1*a*. The pickup roller 1*a* is moved up/down by the solenoid 306 and rotated by a motor 303 rotating at a constant speed. If the pickup roller 1*a* is moved down by the solenoid 306 to come into contact with the topmost sheet of the piled-up sheets 10 while the pickup roller 1*a* is rotating, the sheet 10 which contacts with the pickup roller 1*a* is moved forward toward the sheet feeding roller pair 2*a*. After the sheet tip comes into contact with the sheet feeding roller pair 2*a*, the pickup roller 1*a* is moved up to maintain the pickup roller 1*a* in a non-contact state with the sheet 10. Thus, even if the pickup roller 1*a* is rotating, the pickup roller 1*a* is moved up and the pickup roller 1*a* is maintained in a non-contact state with the sheet 10 and therefore, the sheet 10 is fed to the sheet feeding roller pair 2*a* in an unconstrained state. When the tip of the sheet 10 enters between the sheet feeding roller pair 2*a*, the sheet 10 is fed to the intermediate conveying roller pair 3*a* by the sheet feeding roller pair 2*a* driven by the motor 303.

The conveying clutch 304 constituted of an electromagnetic clutch is inserted between the motor 303 and the pickup roller 1*a*. If manual feeding of the sheet 10 by the user is selected, a manual feeding control signal is provided from the control device 209 to the conveying clutch 304 to disconnect the pickup roller 1*a*. Thus, no rotation driving force is transmitted from the motor 303 to the pickup roller 1*a* and feeding of the sheet 10 from the sheet feeding cassette 9*a* is stopped. If feeding of the sheet 10 from the sheet feeding cassette 9*a* is selected by the user, a cassette feeding control signal is provided from the control device 209 to the conveying clutch 304 to connect with the pickup roller 1*a*. Thus, a rotation driving force is transmitted from the motor 303 to the pickup roller 1*a* and, as described above, the pickup roller 1*a* is rotated to feed the sheet 10 from the sheet feeding cassette 9*a*. The solenoid 306 repeats the operation of moving up and moving down the pickup roller 1*a* in a fixed period in response to the cassette feeding control signal from the control device 209.

The conveying clutch 305 constituted of an electromagnetic clutch is inserted between the motor 303 and the sheet feeding roller pair 2*a*. If manual feeding of the sheet 10 by the user is selected, a manual feeding control signal is provided from the control device 209 to the conveying clutch 305 to disconnect the sheet feeding roller pair 2*a*. Thus, no rotation driving force is transmitted from the motor 303 to the sheet feeding roller pair 2*a* and feeding of the sheet 10 from the sheet feeding roller pair 2*a* to the conveying roller pair 3*a* is stopped. If feeding of the sheet 10 from the sheet feeding cassette 9*a* is selected by the user, a cassette feeding control signal is provided from the control device 209 to the conveying clutch 305 to connect with the sheet feeding roller pair 2*a*. Thus, a rotation driving force is transmitted from the motor 303 to the sheet feeding roller pair 2*a* and the sheet feeding roller pair 2*a* is rotated to feed the sheet 10 from the sheet feeding roller pair 2*a* to the conveying roller pair 3*a*.

The conveying roller pair 3*a* is driven to rotate by a conveying motor 302 provided independently of the motor 303. Thus, the conveying roller pair 3*a* can be driven independently of the pickup roller 1*a* and the sheet feeding roller pair 2*a*. The conveying roller pair 3*a* is arranged on a conveying path common to the conveying path of the manually fed sheet 10 and the conveying path of the sheet 10 from the sheet feeding cassette 9*b* and thus, the conveying motor 302 is driven while being controlled by the control device 209 at all times, as long as the sheet 10 is fed and conveyed.

The sheet 10 conveyed by the conveying roller pair 3*a* is fed to the registration roller pair (also called an aligning unit) 4 and aligned by the registration roller pair 4. A registration motor 301 that drives the registration roller pair 4 is provided independently of the motor 303 and the conveying motor 302 and controlled by the control device 209 to convey the sheet 10 toward the secondary transfer unit 5 after being activated at a predetermined timing.

The sheet conveying mechanism shown in FIG. 7 is only an example and the pickup rollers 1*a* and the sheet feeding roller pairs 2*a* may each be connected to independent motors or the registration roller pair 4 and the conveying roller pairs 3*a* may be connected by a motor and a clutch.

Figure 8:
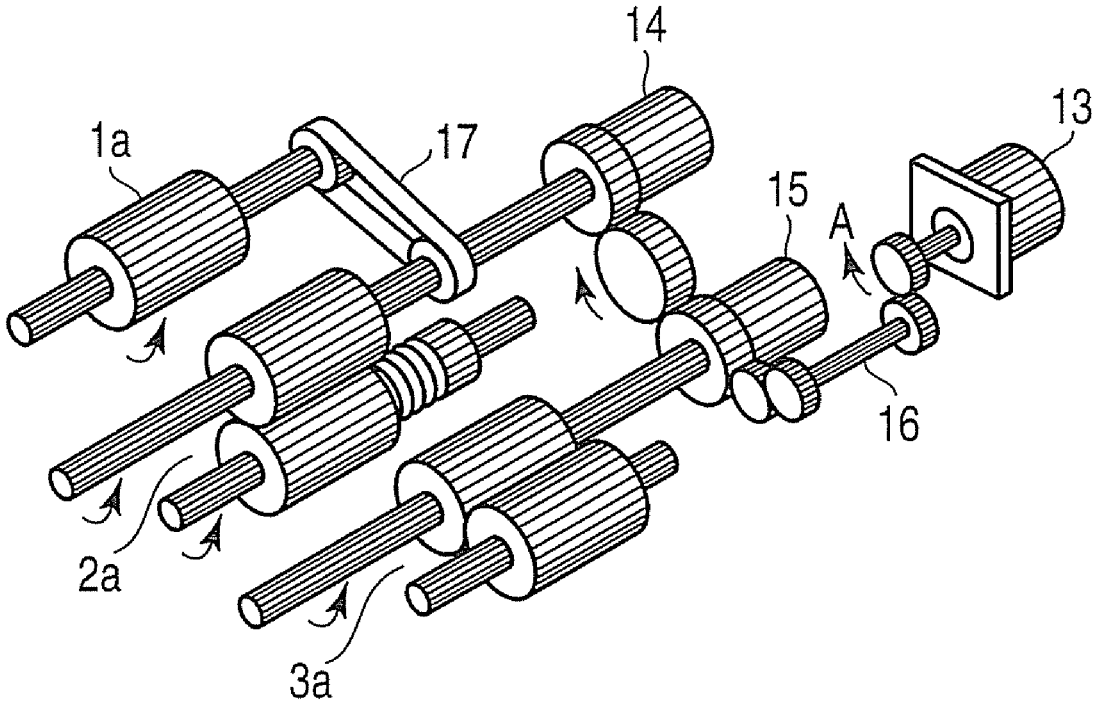
FIG. 8 is a schematic diagram showing an example drive mechanism of a pickup roller, a sheet feeding roller pair, and an intermediate conveying roller pair shown in FIG. 1.

FIG. 8 shows an outline configuration of an example sheet conveying mechanism in which the pickup roller 1*a*, the sheet feeding roller pair 2*a*, and the conveying roller pair 3*a* are driven by one sheet feeding motor 13. As shown in FIG. 8, the sheet conveying mechanism includes the sheet feeding motor 13 rotating in the direction of an arrow A at a constant speed and the rotation driving force of the sheet feeding motor 13 is transmitted to the pickup roller 1*a*, the sheet feeding roller pair 2*a*, and the conveying roller pair 3*a* by a link mechanism 16. The sheet feeding roller pair 2*a* is linked to the sheet feeding motor 13 via a sheet feeding clutch 14 constituted of an electromagnetic clutch, gears, and the link mechanism 16 and driven by the sheet feeding motor 13. The pickup roller 1*a* is linked to the sheet feeding roller pair 2*a* by a timing belt 17 that transmits a rotation driving force and, as a result, the pickup roller 1*a* and the sheet feeding roller pair 2*a* are synchronously driven. The conveying roller pair 3*a* is linked to the sheet feeding motor 13 via an sheet conveying clutch 15 constituted of an electromagnetic clutch, gears, and the link mechanism 16 and driven by the sheet feeding motor 13. In the sheet conveying mechanism shown in FIG. 8, the pickup roller 1*a*, the sheet feeding roller pair 2*a*, and the conveying roller pair 3*a* are driven by one sheet feeding motor 13 and can easily be rotated at the same circumferential velocity.

In the sheet conveying mechanism shown in FIG. 7, as listed in FIG. 9, impulsive sounds or operation sounds are caused by various sound elements.

Various methods to reduce such impulsive sounds caused by a sheet conveying apparatus have been proposed and the inventors focus on the fact that it is very difficult to eliminate all impulsive sounds below an ignorable level. The inventors also focus on the fact that if impulsive sounds that cannot be eliminated are caused at an irregular timing, an uncomfortable feeling is created for the user and the user perceives that noise is produced by a apparatus, but if impulsive sounds that cannot be eliminated are caused in a certain rhythm, a comfortable feeling can be created for the user even if the apparatus causes impulsive sounds. In a sheet conveying apparatus according to one embodiment, a comfortable feeling is created for the user by changing the time at which a sound is caused in accordance with input to cause an impulsive sound in a certain rhythm.

As shown in FIG. 10, operation sounds (sound elements R1 and I1) are caused by the solenoid 306 when the solenoid 306 is turned on and turned off. The sound (sound element R1) when the solenoid 306 is turned on is a mechanical sound when a point of contact of the solenoid 306 is engaged and is non-eliminable. The sound (sound element I1) when the solenoid 306 is turned off is a mechanical sound when the point of contact of the solenoid 306 is disengaged and is deemed to be an ignorably low sound. When the clutches 304 and 305 are turned on or turned off, an operation sound (sound elements R2 and 12) is caused by the clutches 304 and 305 as a mechanical sound. The mechanical sound (sound element R2) when the clutches 304 and 305 are turned on is a non-eliminable sound, but the sound (sound element I2) when the clutches 304 and 305 are turned off is deemed to be an ignorably low sound. When the pickup roller 1*a* collides against the sheet 10, an impulsive sound (sound element R3)

is caused by the pickup roller 1*a* and when the pickup roller 1*a* moves toward the sheet 10 again after retreating, a mechanical impulsive sound (sound element R4) is caused by a mechanism that drives the pickup roller 1*a*. The impulsive sounds (sound elements R3 and R4) caused attendant on the activation of the pickup roller 1*a* are all non-eliminable. An impulsive sound (sound element R3) cased attendant on collision of the pickup roller 1*a* and the sheet 10 is caused almost at the same time as the solenoid 306 is turned on and a mechanical impulsive sound (sound element R4), which is a return sound of the pickup roller 1*a*, is caused almost at the same time as the solenoid 306 is turned off.

Impulsive sounds caused by the clutches 304 and 305 are impulsive sounds generated when the clutches 304 and 305 and the rollers 1*a* and 2*a* are linked. For example, the clutches 304 and 305 and the rollers 1*a* and 2*a* are linked as shown below.

A VCE clutch, which is a dry-type single disc electromagnetic clutch, is taken as an example. A clutch of this type has a structure in which a field (static unit) containing a rotor (rotating unit) and a coil is supported by a ball bearing and a field/rotor assembly and an armature assembly (rotating unit) are integrated. The field/rotor assembly is mounted on a shaft on a remote side, that is, on a shaft of the pickup roller 1*a* or the sheet feeding roller pair 2*a* and the armature assembly is fixed to a member such as a pulley and gear by mounting bolts via a plate spring. The armature and the rotor are mounted with a slight gap therebetween. When power is applied to the coil, a clutch of this type has a magnetic flux generated between the field/rotor and the armature and the armature is attracted to the rotor to engage the clutch. When an exciting voltage is turned off, the magnetic flux disappears and the armature is separated from the rotor by the plate spring to disengage the clutch. Thus, an impulsive sound in clutch engagement (clutch-on) is non-eliminable. A sound caused by the clutches 304 and 305 can be controlled by controlling the clutch-on timing. Application of power to the coil of a clutch can be controlled by providing an on/off signal from a switching circuit.

In the sheet feeding roller pair 2*a*, an impulsive sound (sound element D1) is caused when the tip of the sheet 10 collides against the sheet feeding roller pair 2*a*. The impulsive sound (sound element D1) is eliminable below an ignorable level and the impulsive sound (sound element D1) can be prevented from being caused by rotating the sheet feeding roller pair 2*a* in such a way that the sheet 10 is inserted between the sheet feeding roller pair 2*a* without causing a collision of the sheet 10 against the sheet feeding roller pair 2*a*. When, as an example, the sheet feeding roller pair 2*a* and the pickup roller 1*a* are linked by the timing belt 17 shown in FIG. 8 and rotated in such a way that the sheet feeding roller pair 2*a* is rotated in synchronization with the rotation of the pickup roller 1*a*, the impulsive sound (sound element D1) can be prevented from being caused from the sheet feeding roller pair 2*a*. Also in the conveying roller pair 3*a*, an impulsive sound (sound element D2) is caused when the sheet 10 collides against the conveying roller pair 3*a*, but like the sheet feeding roller pair 2*a*, the impulsive sound (sound element D2) can be eliminated below an ignorable level by synchronizing the rotation of the conveying roller pair 3*a* with conveyance of the sheet 10.

Since the sheet 10 aligns itself by a collision thereof against the registration roller pair 4, the collision of the impulsive 10 is unavoidable and a collision sound (sound element R5) is non-eliminable. That is, an impulsive sound (or a collision sound) attendant on collision of the sheet 10 and the registration roller pair 4 is not eliminable below an ignorable level because the rotation of the roller is stopped when the collision occurs.

Figure 11A:
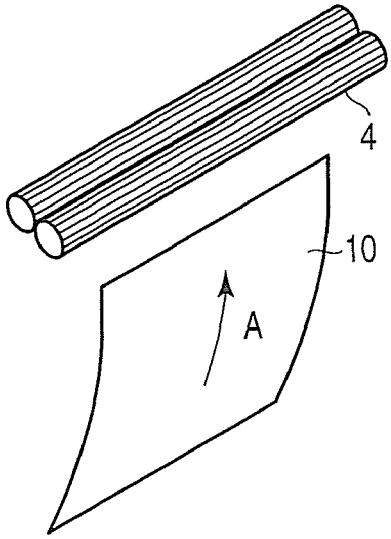
FIG. 11A is an explanatory view illustrating how a sheet is conveyed to the pair of registration rollers shown in FIG. 1.
Figure 11B:
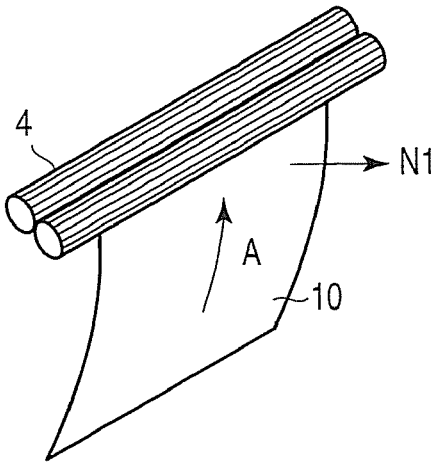
FIG. 11B is an explanatory view illustrating how the sheet collides against the pair of registration rollers shown in FIG. 7 to cause an impulsive sound.

FIGS. 11A and 11B are views illustrating an impulsive sound caused by a collision of the registration roller pair 4 and the sheet 10. As shown in FIG. 11A, the sheet 10 is conveyed to the stopped registration roller pair 4 along the direction indicated by an arrow A. As shown in FIG. 11B, the tip of the sheet 10 is pressed along the nip part of the registration roller pair 4 by being abutted against the stopped registration roller pair 4. An impulsive sound N1 is caused attendant on an operation in which the sheet 10 is caused to collide against the stopped registration roller pair 4. If the registration roller pair 4 is driven while the sheet 10 is pressed against the registration roller pair 4, the posture of the sheet 10 is corrected in the conveyance direction of the registration roller pair 4 while the sheet 10 is conveyed. Thus, even if the sheet 10 is tilted during conveyance, the sheet 10 is aligned by the registration roller pair 4 before being conveyed to the image forming position. The impulsive sound N1 is caused as many times as the number of conveyed sheets 10.

If the registration roller pair 4 and the conveying roller pair 3*a* are rotated at different circumferential velocities when the sheet 10 is sent to the secondary transfer unit 5 by the registration roller pair 4, noise such as a sound of the sheet 10 being stretched and a friction sound between the intermediate conveying roller pair 3*a* and the sheet 10 is produced, as shown in FIG. 9. To avoid such noise, the registration roller pair 4 is rotated at the same circumferential velocity as the circumferential velocity of the conveying roller pair 3*a* until the rear end of the sheet 10 passes through the conveying roller pair 3*a*.

In addition to the above impulsive sound or operation sound, a sound (sound element D3) is caused by the sheet 10 when the sheet 10 that is flexed between the sheet feeding roller pair 2*a* and the conveying roller pair 3*a* is stretched. The sound (sound element D3) can be eliminated below an ignorable level by preventing the conveyed sheet 10 from being flexed. Also, a sound (sound element D4) is caused by the sheet 10 when the sheet 10 that is flexed between the conveying roller pair 3*a* and the registration roller pair 4 is stretched. The sound can be eliminated below an ignorable level by controlling feeding of the sheet 10 so that the flexure is gradually taken up. Further, in the sheet feeding roller pair 2*a*, a sound (sound element D5) is caused by the sheet 10 when the sheet 10 is pulled out faster than the rotational speed of the sheet feeding roller pair 2*a*. Similarly, in the conveying roller pair 3*a*, a sound (sound element D6) is caused by the sheet 10 when the sheet 10 is pulled out faster than the rotational speed of the conveying roller pair 3*a*. Such pullout sounds (sound elements D5 and D6) can be eliminated below an ignorable level by aligning the rotational speed of the sheet feeding roller pair 2*a* and the conveying roller pair 3*a* with the conveyance speed of the sheet 10.

Figure 23:
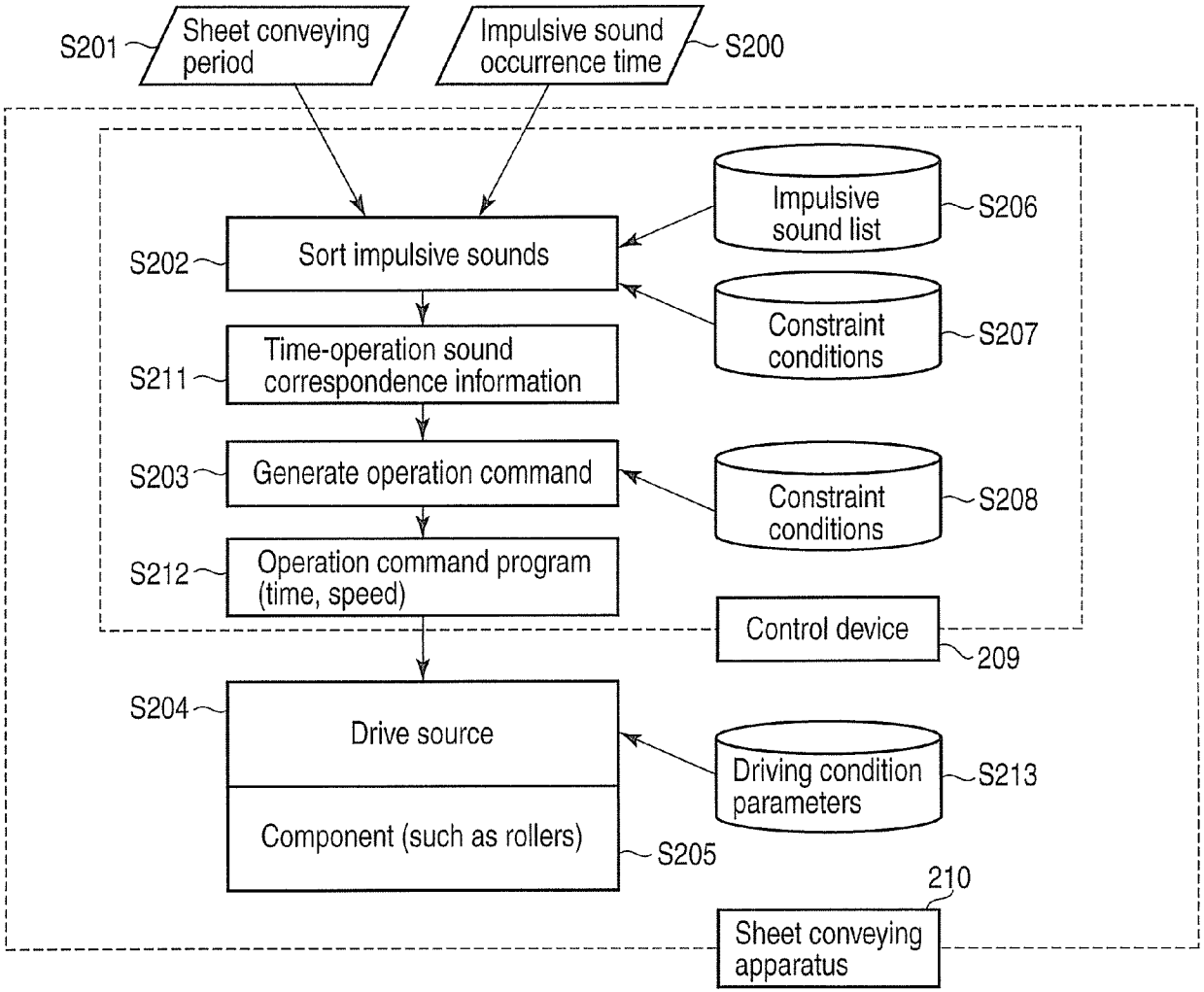
FIG. 23 is a flowchart showing a control procedure for controlling the impulsive sounds by the control device controlling the sheet conveying apparatus according to a sixth embodiment.

In a sheet conveying apparatus according to one embodiment, main sounds in the sound element list shown in FIG. 10 may be registered in a memory of the control device 209 shown in FIG. 23 as an impulsive sound list file S206 with a relation of drive sources S204 causing sounds, components S205, types of caused sounds, and whether controlled by the control device 209 shown in FIG. 7 for reference. In the embodiment, since sounds output from the motors 301, 302, and 303 are assumed to be sufficiently low when compared with a sound caused by a connected roller, the motors 301, 302, and 303 are excluded from sources of impulsive sounds (sound elements).

In FIG. 10, the data format for registration as a sound element list is shown and action to be taken for sounds in the sound element list shown in FIG. 23 is indicated in categories. In the table shown in FIG. 10, the sound element is identified based on the index and the type (category) of the sound element is registered in associated with the index. Sound elements are classified into three types (categories) of sound elements (sound element In excluded from control targets) that can be ignored because the sound is so low, sound elements (sound element Dn controlled to be eliminated below an ignorable level) to be controlled so that no sound is caused, and sound elements (sound element Rn to be rhythm-controlled) to be controlled so that a comfortable feeling is created for the user by controlling the sound element to generate the sound element in a certain rhythm without eliminating the sound. The sound element In that can be ignored because the sound is so low includes the sound element I1 when the solenoid 306 is turned off and the sound element I2 when a clutch is turned off. The sound element Dn to be controlled for elimination includes the impulsive sound D1 of the sheet 10 against the sheet feeding roller pair 2*a*, the impulsive sound D2 of the sheet 10 against the conveying roller pair 3*a*, the sheet sound D3 caused when the sheet 10 that is flexed between the sheet feeding roller pair 2*a* and the conveying roller pair 3*a* is stretched, the sheet sound D4 caused when the sheet 10 that is flexed between the conveying roller pair 3*a* and the registration roller pair 4 is stretched, the frictional sound D5 caused when the sheet 10 is pulled out from the sheet feeding roller pair 2*a*, and the frictional sound D6 caused when the sheet 10 is pulled out from the conveying roller pair 3*a*. The sound element Rn to be rhythm-controlled includes the mechanical impulsive sound R1 when the solenoid 306 is turned on, the mechanical impulsive sound R2 when a clutch is turned on, the impulsive sound R3 when the pickup roller 1*a* collides against the sheet 10, the mechanical impulsive sound R4 when the pickup roller 1*a* returns to the sheet 10 after retreating, and the impulsive sound R5 when the sheet 10 collides against the registration roller pair 4.

The data table shown in FIG. 10 may be stored in an external storage device as a text file or prepared as a data table in the program in advance. The table shown in FIG. 10 may be stored in a nonvolatile memory of the control device 209 as data to be referenced if necessary. Also, information about impulsive sounds and the like caused in other components within the body unit U1, the manuscript conveying unit U2, and the finisher unit U3 may similarly be described in the data table shown in FIG. 10.

Next, impulsive sounds caused in the finisher unit U3 and the manuscript conveying unit U2 will be described. Like the body unit U1, the finisher unit U3 and the manuscript conveying unit U2 each include the solenoid, clutch, rollers and the like acting as sound sources that cause impulsive sounds, and impulsive sounds are caused when the sheet 10 is conveyed. For the finisher unit U3 and the manuscript conveying unit U2, a detailed description of impulsive sounds caused by these sources overlaps with the above description and thus is omitted.

In the finisher unit U3, for example, an impulsive sound is caused by the sheet 10 when the sheet 10 introduced from the body unit U1 is sorted to the finisher trays 51 and 52 by the transfer gate 50. Also when sorting work such as sorting the sheets 10 into groups of the number of copies is done, an impulsive sound is caused attendant on an operation to cause the sheets 10 to be aligned. Also, an impulsive sound is caused attendant on driving a mechanism that does sorting work. As described above, the finisher unit U3 can sort out the sheets 10 on which an image has been formed by the body unit U1 in accordance with the purpose set by the user through the control panel 102. The most frequently used sorting operation in the finisher unit U3 is an operation to align a bundle of sheets in a lateral direction when a plurality of copies is to be printed.

Figure 12:
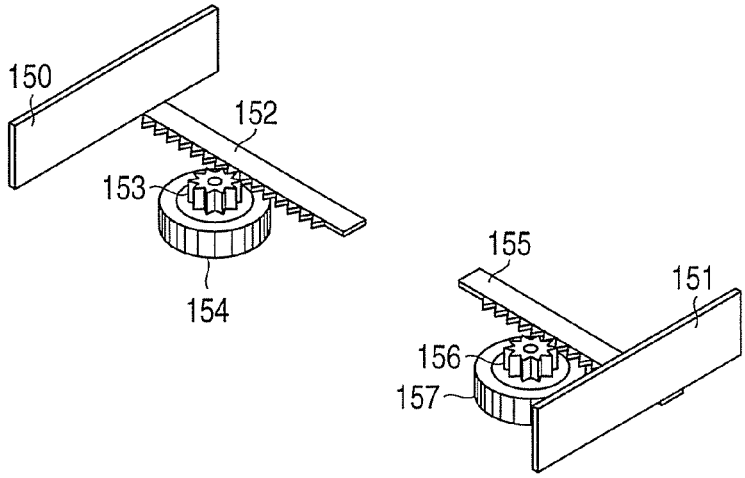
FIG. 12 is a schematic diagram showing a drive mechanism of a sheet aligning paddle shown in FIG. 2.
Figure 13A:
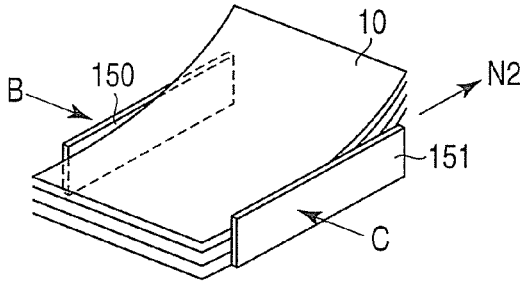
FIG. 13A is an explanatory view illustrating a nipping operation of the sheet aligning paddle shown in FIG. 2.
Figure 13B:
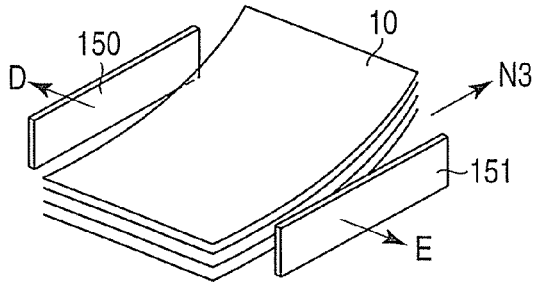
FIG. 13B is an explanatory view illustrating a releasing operation of the sheet aligning paddle shown in FIG. 2.

The operation of aligning sheets will be described with reference to FIGS. 12, 13A, and 13B. To perform a sorting operation, the sheets 10 on which an image has been formed are conveyed from the body unit U1 to the finisher unit U3 and then piled up on the finisher tray 52 via the transfer gate 50. As described above, the sheet aligning unit 52*b* of the finisher tray 52 is provided with the sheet aligning paddles 150 and 151. FIG. 12 schematically shows a drive mechanism of the sheet aligning paddles 150 and 151. As shown in FIG. 12, racks 152 and 155 whose sides are toothed are connected to the sheet aligning paddles 150 and 151, respectively. Pinions 153 and 156 are provided for the racks 152 and 155 to engage with a tooth portion thereof and mounted and fixed to motors 154 and 157, respectively. The motors 154 and 157 are controlled by the control device 209 and driven intermittently so as to align the sheets 10 sequentially piled up on the sheet aligning unit 52*b*. When the motors 154 and 157 are driven, the pinions 154 and 157 are rotated and the sheet aligning paddles 150 and 151 are moved in the lateral direction of the sheet 10. During sheet aligning operation, as shown in FIG. 13A, the sheet aligning paddle 150 is moved in the direction of an arrow B, the sheet aligning paddle 151 is moved in the direction of an arrow C, and the sheets 10 are nipped between the sheet aligning paddles 150 and 151 to align the sheets 10. Then, as shown in FIG. 13B, the sheet aligning paddle 150 is moved in the direction of an arrow D and the sheet aligning paddle 151 is moved in the direction of an arrow E to release the sheets 10. In the sheet aligning operation, impulsive sounds N2 ands N3 are caused during nipping and releasing operation by a mechanism that drives the sheet aligning paddles 150 and 151, respectively. These impulsive sounds N2 and N3 are dominant impulsive sounds among impulsive sounds caused in the finisher unit U3 and are non-eliminable.

In the manuscript conveying unit U2, an impulsive sound is caused attendant on an operation to intermittently operate the manuscript pickup roller 62 to pick up manuscript sheets housed on the manuscript tray 61. Also, an impulsive sound when a manuscript sheet is caused to collide against the registration roller pair 68 for alignment, an impulsive sound attendant on sheet track reversal when a manuscript sheet is conveyed to the manuscript reversal unit 63, and an impulsive sound when a manuscript sheet is delivered to the manuscript delivery tray 65 are caused.

A sheet conveying apparatus according to one embodiment gives a rhythm (beat) to impulsive sounds caused attendant on conveyance of the sheet 10. More specifically, impulsive sounds caused attendant on conveyance of the sheet 10 as described above is caused at time intervals related to a sheet conveyance operation, for example, at a timing obtained by equally dividing the sheet feed time interval into two or more. Experimental results obtained by the inventors and others show that if the division number is 2, 3, or 4, an impulsive sound caused attendant on a sheet conveyance operation is felt comfortably as a working sound of a apparatus and if the division number is 5 or more, comfort is reduced.

In a sheet conveyance system including the body unit U1, the manuscript conveying unit U2, and the finisher unit U3, a one unit of the body unit U1, the manuscript conveying unit U2, or the finisher unit U3 may have a rhythm or at least two of the three units of the body unit U1, the manuscript conveying unit U2, and the finisher unit U3 may be combined to have the rhythm.

In a sheet conveying apparatus according to one embodiment, the arrangement of components of each unit may be adjusted or operations of components may be controlled so that an impulsive sound has a rhythm. Alternatively, the arrangement and control of the components may be combined.

First Embodiment

In a sheet conveying apparatus according to the first embodiment, a rhythm is formed of element sounds caused by the body unit U1. A rhythmical sense perceived in an auditory sense is formed of a sequence of sounds whose duration is very short, such as an impulsive sound.

Figure 14:
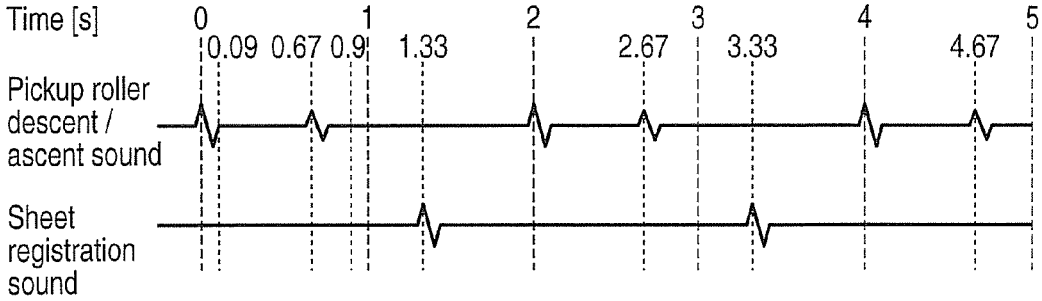
FIG. 14 is a timing chart showing a timing of the impulsive sound being caused in the sheet conveying apparatus according to a first embodiment.

FIG. 14 shows an occurrence timing of impulsive sounds in the sheet conveying apparatus according to the first embodiment. In the first embodiment, a case when impulsive sounds to be controlled are impulsive sounds (sound elements R3 and R4) caused when the pickup roller 1*a* is moved up or moved down and an impulsive sound (sound element R5) caused when the sheet 10 is caused to collide against the registration roller pair 4 will be described. In the sheet conveying apparatus, as shown in FIG. 14, the sheet feed time interval is designed to be two seconds. That is, the pickup roller 1*a* is moved down in a period of two seconds to pick up the sheet 10 from the sheet feeding cassette 9*a*. Then, the sheet conveying apparatus is operated in such a way that the above three impulsive sounds are caused at the timing obtained by equally dividing the sheet feed time interval into three. More specifically, if the time at which an impulsive sound is produced attendant on descent of the pickup roller 1*a* is set as a reference, the sheet conveying mechanism is controlled in such a way that an impulsive sound attendant on ascent of the pickup roller 1*a* is caused about 0.67 s after the reference time and an impulsive sound attendant on a collision between the sheet 10 and the registration roller pair 4 is caused about 1.33 s after the reference time. Thus, if impulsive sounds are caused at the timing obtained by equally dividing the sheet feed time interval into three, the occurrence of impulsive sounds can be made to be perceived as the simple triple time.

Incidentally, the timing to cause impulsive sounds is not limited to the timing obtained by equally dividing the sheet feed time interval into three and may be the timing obtained by equally dividing the sheet feed time interval into two or four. If impulsive sounds are caused at the timing obtained by dividing the sheet feed time interval into two, that is, impulsive sounds are caused at the timing obtained by equally dividing the time interval of an operation to move down the pickup roller 1*a* into two, the occurrence of impulsive sounds can be made to be perceived as the simple double time. In this case, an impulsive sound attendant on ascent of the pickup roller 1*a* and an impulsive sound attendant on a collision between the sheet 10 and the registration roller pair 4 may be caused simultaneously one second after the reference time. Alternatively, an impulsive sound attendant on ascent of the pickup roller 1*a* may be made so low that the impulsive sound becomes inaudible to cause an impulsive sound attendant on a collision between the sheet 10 and the registration roller pair 4 one second after the reference time.

If impulsive sounds are caused at the timing obtained by equally dividing the sheet feed time interval into four, the occurrence of impulsive sounds can be made to be perceived as the simple quadruple time. In this case, an impulsive sound attendant on ascent of the pickup roller 1*a* and an impulsive sound attendant on a collision between the sheet 10 and the registration roller pair 4 may each be caused at the timing of 0.5 s, 1 s, or 1.5 s after the reference time. In this case, no impulsive sound is caused at one of the timing of 0.5 s, 1 s, and 1.5 s after the reference time. In a sheet conveying apparatus according to the first embodiment, as described above, impulsive sounds may be caused at the timing obtained by equally dividing the sheet feed time interval and thus, the timing when a plurality of impulsive sounds is caused simultaneously or the timing when no impulsive sound is caused may be present.

As described above, impulsive sounds are felt comfortable when impulsive sounds are caused at the timing obtained by equally dividing the sheet feed time interval into two, three or four. If impulsive sounds are caused at the timing obtained by dividing the sheet feed time interval into five or more, comfort is reduced. Thus, it is only necessary to prevent an impulsive sound from being caused at the timing obtained by dividing the sheet feed time interval into five. That is, a sheet conveying apparatus according to an embodiment needs to be configured so that the time interval between impulsive sounds does not fall below 20% of the sheet feed time interval. Thus, if impulsive sounds are caused at the timing obtained by equally dividing the sheet feed time interval into four, that is, impulsive sounds are caused at the timing following the time interval equal to 25% of the sheet feed time interval, a comfortable rhythmical sense can be provided by causing impulsive sounds within the range of ±5% of the sheet feed time interval from the timing obtained by dividing the sheet feed time interval into four. When the sheet feed time interval is divided into n, dividing the time interval equally by including an error like the one described above is herein permitted.

A sheet conveying apparatus according to an embodiment is not limited to forming a rhythm based on impulsive sounds caused by the body unit U1 and one unit of the manuscript conveying unit U2 and the finisher unit U3 may be caused to have a rhythm. In the finisher unit U3, for example, an impulsive sound is caused attendant on an operation in which the sheet 10 is introduced from the body unit U1, sorting work of the sheet 10, an operation to move up and move down the finisher trays 51 and 52, and a staple operation. Also in the finisher unit U3, a rhythm can be configured regarding these impulsive sounds according to a procedure similar to the procedure for configuring a rhythm for the body unit U1. For example, the control device 209 can use an impulsive sound caused attendant on an operation in which the sheet 10 is delivered from the body unit U1 as a reference to control the operation of the finisher unit U3 so that other impulsive sounds are caused at the timing obtained by equally dividing the time interval of the delivery operation of the sheets 10. Also in the finisher unit U3, as described above, impulsive sounds to be controlled and components to cause an impulsive sound may be decided in accordance with the order of operation in the finisher unit U3 when appropriate to configure a rhythm from these impulsive sounds.

Also in the manuscript conveying unit U2, a rhythm may be configured from impulsive sounds caused by driving the rollers attendant on a reading operation of manuscript sheets and the like according to a procedure similar to the procedure for the body unit U1 or the finisher unit U3.

As described above, a sheet conveying apparatus according to the first embodiment is configured to produce impulsive sounds at the timing obtained by equally dividing the sheet feed time interval in one unit of the body unit U1, the manuscript conveying unit U2, and the finisher unit U3. Therefore, the sheet conveying apparatus can be operated with a comfortable working sound.

Second Embodiment

In the MFP shown in FIG. 1, the body unit U1, the manuscript conveying unit U2, and the finisher unit U3 are operated simultaneously in accordance with the number of copies. In the second embodiment, a rhythm is configured by combining impulsive sounds caused by the units U1, U2, and U3. If, for example, impulsive sounds are caused at the timing obtained by dividing the sheet feed time interval into four, the time at which the pickup roller 1*a* is moved down in the body unit U1 is set as a reference time, and the timing of an impulsive sound attendant on an operation in which the pickup roller 1*a* is moved up and the timing of an impulsive sound attendant on a collision between the sheet 10 and the registration roller pair 4 are allocated to two locations of three locations of timing obtained by equally dividing the time interval into four. Further, for example, an impulsive sound caused by the finisher unit U3 attendant on alignment of sorting work of sorting the sheet 10 into groups of the number of copies can be allocated to the remaining one location. Accordingly, impulsive sounds caused by the body unit U1 and the finisher unit U3 can be made to be perceived as the simple quadruple time.

In the second embodiment, impulsive sounds to be controlled are assumed to be, as an example, three impulsive sounds of the impulsive sound N1 attendant on a collision between the sheet 10 and the registration roller pair 4 in the body unit U1 and the impulsive sounds N2 and N3 caused by a mechanism that drives the sheet aligning paddles 150 and 151 in the finisher unit U3. The noise level of other impulsive sounds caused by other components is reduced by adjusting members and the like. A sheet conveying apparatus according to the second embodiment is designed so that the three impulsive sounds N1, N2 and N3 have a rhythm (beat).

First, the conveying path and sheet conveyance operation of the sheet 10 when an image forming operation is continuously performed will be described. In the second embodiment, the conveyed sheet 10 has, as an example, the A4 size and is conveyed in a shorter direction of the sheet 10. The length of the A4-size sheet 10 in the shorter direction is 210 mm. The sheets 10 are successively conveyed at intervals of two seconds from the sheet feeding cassette 9*a*. That is, a sheet conveying apparatus according to the second embodiment operates at the sheet feed speed of 30 sheets/min for the transverse A4-size sheet 10.

The sheets 10 housed in the sheet feeding cassette 9*a* are picked up one-by-one by the pickup roller 1 to be fed one after another by the sheet feeding roller pair 2*a*. Each of the fed sheets 10 is conveyed to the registration roller pair 4 by the conveying roller pair 3*a* and abutted against the stopped registration roller pair 4 to adjust the inclination of the sheet 10. The collision sound N1 is caused by a collision between the sheet 10 and the registration roller pair 4. Then, the registration roller pair 4 is driven to feed the sheet 10 to the secondary transfer unit 5, where an image is transferred and formed. The sheet 10 on which an image has been formed is conveyed to the finisher unit U3 by the transfer roller 34, the fixing roller 6, the delivery roller pair 7 or the like. After being conveyed to the finisher unit U3, the sheet 10 is sorted by the transfer gate 50 before being conveyed to the finisher tray 52. Each time one sheet 10 is conveyed, the sheet aligning paddles 150 and 151 are driven in the finisher tray 52 and the sheets 10 are nipped between the sheet aligning paddles 150 and 151 from both sides in the longer direction of the sheet 10 to align the sheets 10. The impulsive sounds N1 and N2 are caused when the sheets 10 are nipped between the paddles 150 and 151 and a release operation is performed, respectively.

Figure 15:
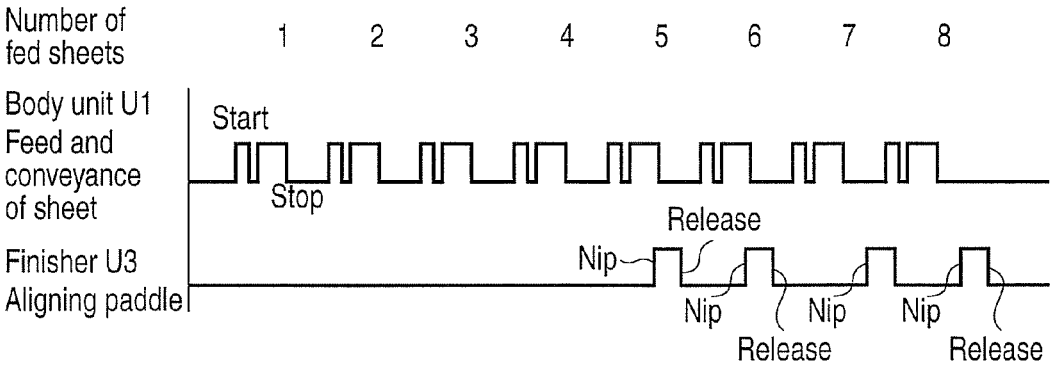
FIG. 15 is a timing chart showing a timing of a sheet conveyance operation in the sheet conveying apparatus according to a second embodiment.

FIG. 15 schematically shows an operation timing of sheet conveyance in the sheet conveying apparatus according to the second embodiment and an operation timing of the sheet aligning paddles 150 and 151. In the second embodiment, the pickup roller 1*a*, the sheet feeding roller pair 2*a*, and the conveying roller pair 3*a* are driven by one sheet feeding motor 13 shown in FIG. 8. When the sheet 10 abuts against the stopped registration roller pair 4, the sheet feeding motor 13 is temporarily stopped. Thus, the sheet 10 is stopped on the conveying path for a time necessary to correct the inclination of the sheet 10 by the registration roller pair 4. Then, the registration roller pair 4, the fixing roller 6, and the delivery roller pair 7 are driven to convey the sheet 10 up to the finisher tray 52 of the finisher unit U3 by passing through the image forming position.

If a plurality of sheets 10 is continuously conveyed one after another, the first sheet 10 is delivered to the finisher tray 52 substantially simultaneously with the fifth sheet 10 being fed. Thus, as shown in FIG. 15, the sheet aligning paddles 150 and 151 are driven for the first time after the fifth sheet 10 is fed.

Figure 16:
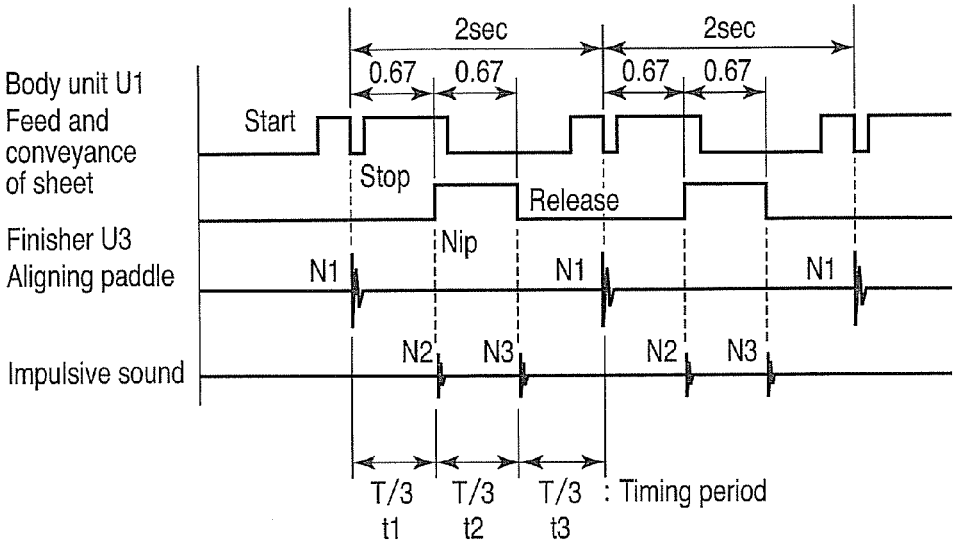
FIG. 16 is a timing chart showing a timing of the impulsive sound being caused in the sheet conveying apparatus according to the second embodiment.

FIG. 16 concretely shows relationships between driving of the sheet conveying mechanism and the sheet aligning paddles 150 and 151 of the body unit U1 and the timing of occurrence of the impulsive sounds N1, N2, and N3 in the time in which the fifth sheet and the sixth sheets 10 are fed. In the finisher unit U3, the sheet aligning paddles 150 and 151 are driven when each sheet 10 arrives at the finisher tray 52. The sheet 10 passing through the registration roller pair 4 is detected by a sheet sensor (not shown) arranged immediately before the registration roller pair 4 on the conveying path and a nipping operation and a release operation of the sheet aligning paddles 150 and 151 are performed in synchronization with a detection signal output from the sheet sensor.

The sheet feed time interval T of the transverse A4-size sheet 10 is set to two seconds and thus, an occurrence time interval of the impulsive sound N1 in the registration roller pair 4 matches the sheet feed time interval T and becomes two seconds. In the example shown in FIGS. 15 and 16, the nipping operation and the release operation of the sheet aligning paddles 150 and 151 are performed at the timing obtained by dividing the sheet feed time interval T into three. That is, an occurrence time of the impulsive sound N1 attendant on a collision between the sheet 10 and the registration roller pair 4 is set as a reference time, the impulsive sound N2 attendant on the nipping operation of the sheet aligning paddles 150 and 151 is caused about 0.66 s after the reference time, and the impulsive sound N3 attendant on the release operation of the sheet aligning paddles 150 and 151 is caused about 1.33 s after the reference time. If the impulsive sound N1 in the registration roller pair 4 is expressed as "ton", the impulsive sound N2 of the nipping operation of the sheet aligning paddles 150 and 151 as "cha", and the impulsive sound N3 of the release operation of the sheet aligning paddles 150 and 151 as "cha", the sheet conveying apparatus according to the second embodiment operates with a rhythmical working sound of "ton cha cha".

The above series of operations is performed by a control method being described in a sequence program stored in the system memory 101B of the main unit 101 in advance.

If the sheet size is changed, the sheet feed time interval is changed. However, by changing the operation timing of the sheet aligning paddles 150 and 151 according to information for the sheet which is set from the control panel 102 or the like, the impulsive sounds N2 and N3 of the nipping operation and the release operation of the sheet aligning paddles 150 and 151 can be caused at the timing obtained by equally dividing the sheet feed time interval respectively.

If, for example, the user sets to store A3-size sheets in the sheet feeding cassette 9*b* and to form an image on the A3-size sheets 10 using the control panel 102, the main unit 101 selects a sequence program in accordance with the setting information from the system memory 101B and outputs a control signal to each component to control the operation of each component according to the setting information. If an image is formed on the A3-size sheet 10, which is twice the A4 size in the conveyance direction, the speed of conveying the sheet 10 is not changed and thus, the sheet feed time interval T is twice that of the A4 size, that is, four seconds. Correspondingly, the occurrence time interval of the impulsive sound N1 in the registration roller pair 4 is four seconds. Thus, the impulsive sound N2 is caused about 1.33 s after the reference time at which the impulsive sound N1 is caused in the registration roller pair 4 and the impulsive sound N3 is caused about 2.66 s after the reference time. Therefore, even if the sheet feed time interval is changed accompanying the change in sheet size, each component is controlled in such a way that the impulsive sounds are caused at times determined based on the timing obtained by equally dividing the sheet feed time interval.

In a sheet conveying apparatus according to the second embodiment, as described above, control is exercised so that impulsive sounds caused by at least two units of the body unit U1, the manuscript conveying unit U2, and the finisher unit U3 are combined to cause impulsive sounds at the timing obtained by equally dividing the sheet feed time interval. Therefore, a sheet conveying apparatus can be caused to operate with a comfortable working sound also when a plurality of units is combined for operation.

Third Embodiment

A sheet conveying apparatus according to the third embodiment will be described with reference to FIGS. 17 to 19D. In the third embodiment, the arrangement of components causing an impulsive sound is determined for impulsive sounds caused in the sheet conveying mechanism shown in FIG. 1 so that impulsive sounds are caused at a predetermined timing. In the description of the third embodiment, components causing an impulsive sound do not refer to a drive unit or the like that actually causes an impulsive sound, but refer to the pickup roller 1*a* and the like arranged along the conveying path of the sheet 10 and having a drive unit that causes an impulsive sound. In the third embodiment, it is assumed that components causing an impulsive sound are the pickup roller 1*a*, the conveying roller pair 3*a*, and the registration roller pair 4.

A sheet conveying apparatus according to the third embodiment includes a drive mechanism as shown in FIG. 8 and is designed to maintain a constant speed V at which the sheet 10 is conveyed. That is, each roller is driven in such a way that circumferential velocities of all rollers are constant. In the drive mechanism, an impulsive sound caused when the sheet feeding clutch 14 is stopped is deemed, like an impulsive sound caused when driven, to have a magnitude that cannot be ignored.

Incidentally, the pickup roller 1*a*, the sheet feeding roller pair 2*a*, and the conveying roller pair 3*a* may each include a drive mechanism to be independently driven.

In a sheet conveying apparatus according to the third embodiment, four impulsive sounds are caused between the time at which one sheet 10 is picked up from the sheet feeding cassette 9*a* and the time at which the sheet 10 passes through the registration roller pair 4. The pickup roller 1*a*, the conveying roller pair 3*a*, and the registration roller pair 4 are arranged in such a way that these impulsive sounds are caused at the timing obtained by equally dividing the sheet feed time interval. That is, the arrangement of the pickup roller 1*a*, the conveying roller pair 3*a*, and the registration roller pair 4 is determined so that an impulsive sound is caused when a time $t_\alpha$ satisfies Formula 1 below:

$$t_\alpha = \frac{\alpha}{n} \cdot T + t_0. \tag{1}$$

In Formula 1, T denotes the sheet feed time interval, the $t_0$ denotes a time when the first impulsive sound is caused (also called the initial time), n denotes the division number and is integer of 2 or more, and $\alpha$ denotes an integer of 0 or more and less than n ($0 \leqq \alpha < n$).

The division number n is set to 2, 3, or 4. When the sheet feed time interval is equally divided into n, dividing the time interval equally by containing an error like the one described above is herein permitted.

Impulsive sounds in the third embodiment are impulsive sounds caused abruptly between the time at which the sheet 10 is picked up from the sheet feeding cassette 9*a* and the time at which the sheet 10 passes through the registration roller pair 4 and do not include continuously caused working sounds like a motor sound caused by a motor that drives various rollers such as the registration roller pair 4.

Figure 17:
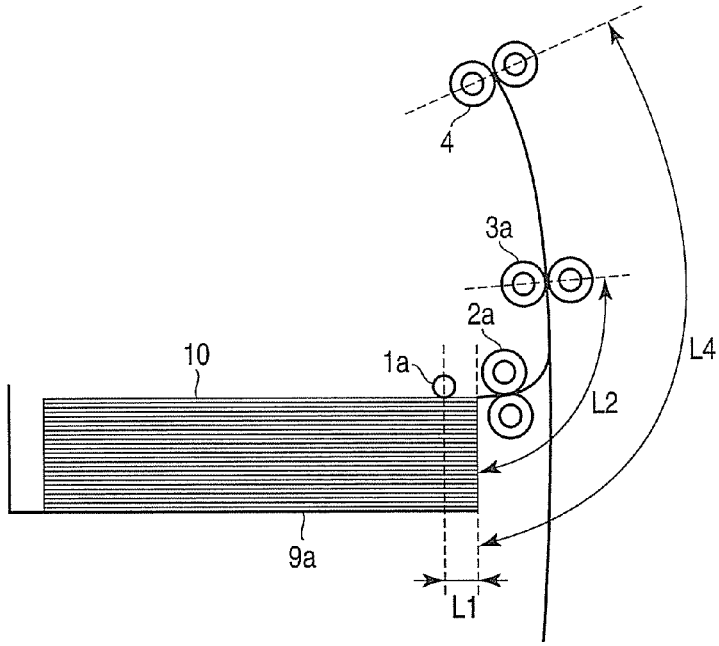
FIG. 17 is a schematic diagram more concretely showing an example of the sheet conveying mechanism from the sheet feeding cassette to the registration roller pair shown in FIG. 1.

FIG. 17 schematically shows an arrangement relation of components in the sheet conveying mechanism ranging from the sheet feeding cassette 9*a* to the registration roller pair 4. In the third embodiment, impulsive sounds to be controlled include four impulsive sounds: a drive impulsive sound caused attendant on driving a sheet feeding clutch 14, a stop impulsive sound caused attendant on stopping the sheet feeding clutch 14, a drive impulsive sound caused attendant on driving the sheet conveying clutch 15, and an impulsive sound caused attendant on a collision of the sheet 10 against the registration roller pair 4. These impulsive sounds are conspicuously greater than the volume of sounds caused by other elements and working sounds that can hardly be eliminated below an ignorable level by a sound absorbing material. Each of the impulsive sounds is caused once each time one sheet 10 is conveyed. Thus, a total of four impulsive sounds are caused between the time at which one sheet of the sheet 10 is picked up from the sheet feeding cassette 9*a* and the time at which the sheet 10 passes through the registration roller pair 4.

Next, the method of determining the arrangement of the pickup roller 1*a*, the conveying roller pair 3*a*, and the registration roller pair 4 according to the third embodiment will be described. The arrangement of the pickup roller 1*a*, the conveying roller pair 3*a*, and the registration roller pair 4 provided along the conveying path of the sheet 10 is determined from the timing of causing an impulsive sound and the position of the sheet 10 on the conveying path when an impulsive sound is caused. For example, the arrangement location of the conveying roller pair 3*a* is determined within a certain range on the conveying path under the condition that the intermediate conveying roller pair 3*a* needs be driven before the sheet 10 is conveyed to the conveying roller pair 3*a* and the condition that the intermediate conveying roller pair 3*a* is driven and an impulsive sound is caused at a preset timing.

A value corresponding to a division point obtained by equally dividing the sheet feed time interval T and specific to an impulsive sound source is denoted below as $\alpha_i$ ($0 \leqq \alpha_i < n$, i=1, 2, 3, 4), a first specific value that identifies a drive impulsive sound caused by the sheet feeding clutch 14 is set as $\alpha_1$, a second specific value that identifies a drive impulsive sound caused by the sheet conveying clutch 15 is set as $\alpha_2$, a third specific value that identifies a stop impulsive sound caused by the sheet feeding clutch 14 is set as $\alpha_3$, and a fourth specific value that identifies an impulsive sound caused by the registration roller pair 4 is set as $\alpha_4$. If the values $\alpha_1$ to $\alpha_4$ are determined as described above, the time when a drive impulsive sound of the sheet feeding clutch 14 is caused is represented as $(t_0+T\times\alpha_1/n)$, the time when a drive impulsive sound of the sheet conveying clutch 15 is caused is represented as $(t_0+T\times\alpha_2/n)$, the time when a stop impulsive sound of the sheet feeding clutch 14 is caused is represented as $(t_0+T\times\alpha_3/n)$, and the time when an impulsive sound of the registration roller pair 4 is caused is represented as $(t_0+T\times\alpha_4/n)$. The arrangement of the pickup roller 1*a*, the conveying roller pair 3*a*, and the registration roller pair 4 is determined under the conditions that impulsive sounds are caused at these times.

Further, the speed of conveying the sheet 10 is set as V and the length of the sheet 10 as Ls. The sheet conveying apparatus of the third embodiment is designed so that circumferential velocities of the pickup roller 1*a*, the sheet feeding roller pair 2*a*, the conveying roller pair 3*a*, and the registration roller pair 4 are all the same and the conveyance speed V is maintained constant. The position of the tip of the sheet 10 piled up in the sheet feeding cassette 9*a* is set as the reference of a conveyance distance along the conveying path, and the conveyance distance is defined in the direction from the upstream side to the downstream side. As shown in FIG. 17, the conveyance distance between the reference and the pickup roller 1*a* is set as $L_1$, the conveyance distance between the reference and the conveying roller pair 3*a* is set as $L_2$, and the conveyance distance between the reference and the registration roller pair 4 is set as $L_4$. The conveyance distance between the reference and the conveying roller pair 3*a* may be also expressed as $L_3$. The conveyance distances $L_2$ and $L_3$ denote the same conveyance distance.

The conveyance distance $L_1$ is determined under the condition that the pickup roller 1*a* needs to come into contact with the topmost sheet of the sheets 10 housed in the sheet feeding cassette 9*a*. The conveyance distance $L_2$ is determined under the condition that the conveying roller pair 3*a* is driven before the sheet 10 is conveyed to the conveying roller pair 3*a*. The conveyance distance $L_3$ is determined under the condition that the sheet feeding clutch 14 is stopped after the tip of the sheet 10 passes through the intermediate conveying roller pair 3*a*. The conveyance distance $L_4$ is determined under the condition that the sheet 10 collides against the registration roller pair 4 at a time determined from the specific value $\alpha_4$. The conveyance distance $L_2$ and the conveyance distance $L_3$ both represent the conveyance distance between the reference and the conveying roller pair 3*a* and thus, the conveyance distance between the reference and the conveying roller pair 3*a* is determined by two formulas determining the conveyance distance $L_2$ and the conveyance distance $L_3$.

Therefore, the arrangement of the pickup roller 1*a*, the conveying roller pair 3*a*, and the registration roller pair 4 is determined in such a way that the following formulas are satisfied:

$$-L_s < L_1 < 0 \tag{2}$$

$$V\left(\frac{\alpha_2}{n}T + t_0\right) < L_2 < V\left(\frac{\alpha_2}{n}T + t_0\right) + L_s \tag{3}$$

$$V\left(\frac{\alpha_3}{n}T + t_0\right) - L_s < L_3 < V\left(\frac{\alpha_3}{n}T + t_0\right) \tag{4}$$

$$L_4 = V\left(\frac{\alpha_4}{n}T + t_0\right) \tag{5}$$

The right side of Formula 3 and the left side of Formula 4 represent the condition that the conveying roller pair 3*a* does not change the arrangement order with adjacent rollers.

By determining the arrangement of the pickup roller 1*a*, the conveying roller pair 3*a*, and the registration roller pair 4 according to the conveyance distances $L_1$ to $L_4$ satisfying the above Formulas 2 to 5, a sheet conveying apparatus can be configured so that impulsive sounds are caused at the timing obtained by equally dividing the sheet feed time interval T into n.

In the third embodiment, it is assumed that one sheet 10 is conveyed on the conveying path every the sheet feed time interval T. If a plurality of sheets 10 is successively conveyed and two or more of the sheets 10 are on the conveying path from the sheet feeding cassette 9*a* or 9*b* to the delivery roller pair 7, the second sheet 10 or a subsequent sheet 10 will be picked up from the sheet feeding cassette 9*a* or 9*b* before the first sheet 10 is delivered by the delivery roller pair 7. Thus, before the first sheet 10 is delivered, an impulsive sound originating from conveyance of the second sheet 10 or a subsequent sheet 10 is caused. The number of impulsive sounds caused by the sheet conveyance operation is denoted as N and a consecutive number x is attached to the N impulsive sounds in order of occurrence to call an impulsive sound represented by the consecutive number x as an impulsive sound x. N is an integer of 2 or more and x is an integer of 1 or more and N or less. Impulsive sounds from components positioned downstream from the delivery roller pair 7 are contained in the N impulsive sounds. The position of the tip of the first sheet 10 when the impulsive sound of x=1 is caused is set as a reference and the conveyance distance from the reference to a component causing the impulsive sound x along the conveying path is denoted as Lx. It is also assumed that m sheets are conveyed on the conveying path. If the impulsive sound x is caused when the component that causes the impulsive sound x and the tip of the first sheet 10 are at the same position, the conveyance distance Lx satisfies the following formula within the range in which the sheet 10 can be conveyed:

$$L_x = V\cdot[t_\alpha + (m-1)\cdot T] \tag{6}$$

If the impulsive sound x is caused when the tip of the first sheet of the sheet 10 is positioned downstream from the component that causes the impulsive sound x on the conveying path, the conveyance distance Lx satisfies the following formula within the range in which the sheet 10 can be conveyed:

$$V\cdot[t_\alpha + (m-1)\cdot T] - L_s < L_x < V\cdot[t_\alpha + (m-1)\cdot T] \tag{7}$$

The left side of Formula (7) represents the condition that the component that causes the impulsive sound x does not change the arrangement order with adjacent components.

If the impulsive sound x is caused when the tip of the first sheet of the sheet 10 is positioned upstream from the component that causes the impulsive sound x on the conveying path, the conveyance distance Lx satisfies the following formula within the range in which the sheet 10 can be conveyed:

$$V\cdot[t_\alpha + (m-1)\cdot T] < L_x < V\cdot[t_\alpha + (m-1)\cdot T] + L_s \tag{8}$$

The right side of Formula (8) represents the condition that the component that causes the impulsive sound x does not change the arrangement order with adjacent components.

Next, to deepen understanding of the sheet conveying apparatus according to the third embodiment, Example 1 and Example 2 will concretely be described with reference to FIG. 18 and FIGS. 19A to 19D.

Example 1

Figure 18:
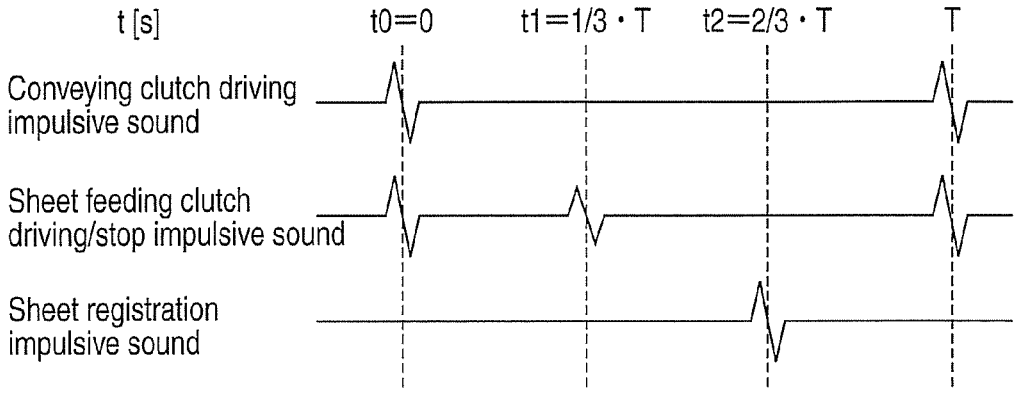
FIG. 18 is a timing chart showing a timing of the impulsive sound being caused in the sheet conveying apparatus according to Example 1 of a third embodiment.

In Example 1, the sheet feed time interval T is set to 2 [s/sheet], the division number n of the sheet feed time interval to 3, the initial time $t_0$ to 0 [s], the conveyance speed V to 150 [mm/s], and the sheet length Ls to 210 [mm]. Also, $\alpha_1=0$, $\alpha_2=0$, $\alpha_3=1$, and $\alpha_4=2$ are set. That is, as shown in FIG. 18, at time t=0, the sheet conveying clutch 15 is driven and also the sheet feeding clutch 14 is driven so that two impulsive sounds are caused. Next, at time t=T/3, the sheet feeding clutch 14 is stopped and an impulsive sound is caused and at time t=2T/3, the tip of the conveyed sheet 10 collides against the registration roller pair 4 to cause an impulsive sound.

In this case, the conveyance distances $L_1$ to $L_4$ are determined as $-210$ [mm]$<L_1<0$ [mm], 0 [mm]$<L_2=L_3<100$ [mm], and $L_4=200$ [mm] from Formulas 2 to 5.

In Example 1, an impulsive sound caused attendant on driving the sheet conveying clutch 15 and an impulsive sound caused attendant on driving the sheet feeding clutch 14 are caused simultaneously at time t=0. On/off of the sheet feeding clutch 14 and the sheet conveying clutch 15 is controlled in such a way that the timings of these two impulsive sounds match perfectly, but the impulsive sounds may be shifted depending on the control precision or conveyance precision.

How much time difference of occurrences of sounds caused by a plurality of sources allows a human auditory sense to recognize a plurality of sounds has been investigated in connection with the study of the method of high-efficiency compression encoding of sound (see Acoustical Science and Technology Vol. 60, No. 1 issued by The Acoustical Society of Japan, 2004, pp. 18 to 23 (written by Miyasaka)). According to the study, a sound from a plurality of sources is normally recognized as a plurality of sounds when the time difference between sound occurrences is about 50 to 200 [ms]. Thus, if a plurality of impulsive sounds is caused simultaneously within 50 ms, these impulsive sounds are recognized as one sound for humans.

In Example 1, 150 [mm/s] is set as the conveyance speed V and if, for example, the time difference of occurrences of two impulsive sounds should be within 50 [ms], an error of the position of each roller is permitted up to about ($\pm150\times0.025=$) $\pm3.17$ [mm]. This is a range that can adequately be implemented in the apparatus design and thus, as described above, a plurality of impulsive sounds can sufficiently be matched so as not to be recognized by humans.

Example 2

Figure 19A:
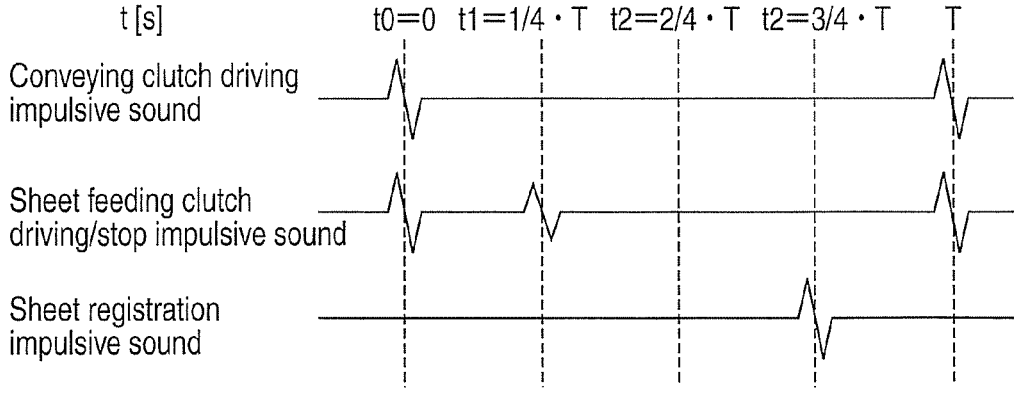
FIG. 19A is a timing chart showing a timing of the impulsive sound being caused in the sheet conveying apparatus according to Example 2 of the third embodiment.

In Example 2, the sheet feed time interval T is set to 2 [s/sheet], the division number n of the sheet feed time interval to 4, the initial time $t_0$ to 0 [s], the conveyance speed V to 160 [mm/s], and the sheet length Ls to 210 [mm]. Also, $\alpha_1=0$, $\alpha_2=0$, $\alpha_3=1$, and $\alpha_4=3$ are set. That is, as shown in FIG. 19A, at time t=0, the sheet conveying clutch 15 is driven and also the sheet feeding clutch 14 is driven so that impulsive sounds are caused. Next, at time t=T/4, the sheet feeding clutch 14 is stopped and an impulsive sound is caused and at time t=3T/4, the tip of the conveyed sheet 10 collides against the registration roller pair 4 to cause an impulsive sound. In this case, the conveyance distances $L_1$ to $L_4$ are determined as $-210$ [mm] $<L_1<0$ [mm], 0 [mm]$<L_2=L_3<80$ [mm], and $L_4=240$ [mm] from Formulas 2 to 5.

In Example 2, while drive impulsive sounds of the sheet conveying clutch 15 and the sheet feeding clutch 14 are caused at time t=0, no impulsive sound is caused at time t=T/2. Thus, regarding the time of causing an impulsive sound, there may be a division point like time t=0 where a plurality of impulsive sounds are caused or a division point like time t=T/2 where no impulsive sound is caused.

Figure 19B:
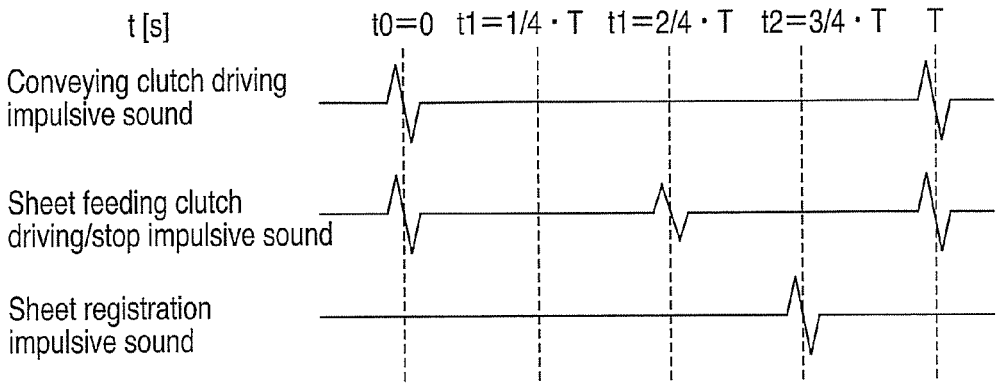
FIG. 19B is a timing chart showing a timing of the impulsive sound being caused in the sheet conveying apparatus according to a first modification of Example 2.

In Example 2, the timing of causing each impulsive sound can be changed. A first modification to a third modification of a sheet conveying apparatus according to example 2 will be described with reference to FIGS. 19B to 19D. In a sheet conveying apparatus according to the first modification, changes are made to $\alpha_1=0$, $\alpha_2=0$, $\alpha_3=2$, and $\alpha_4=3$. That is, as shown in FIG. 19B, at time t=0, the sheet conveying clutch 15 is driven and also the sheet feeding clutch 14 is driven so that impulsive sounds are caused. Next, at time t=2T/4, the sheet feeding clutch 14 is stopped and an impulsive sound is caused and at time t=3T/4, the tip of the conveyed sheet 10 collides against the registration roller pair 4 to cause an impulsive sound. In this case, the conveyance distances $L_1$ to $L_4$ are determined as $-210$ [mm]$<L_1<0$ [mm], 0 [mm]$<L_2=L_3<160$ [mm], and $L_4=240$ [mm] from Formulas 2 to 5.

Figure 19C:
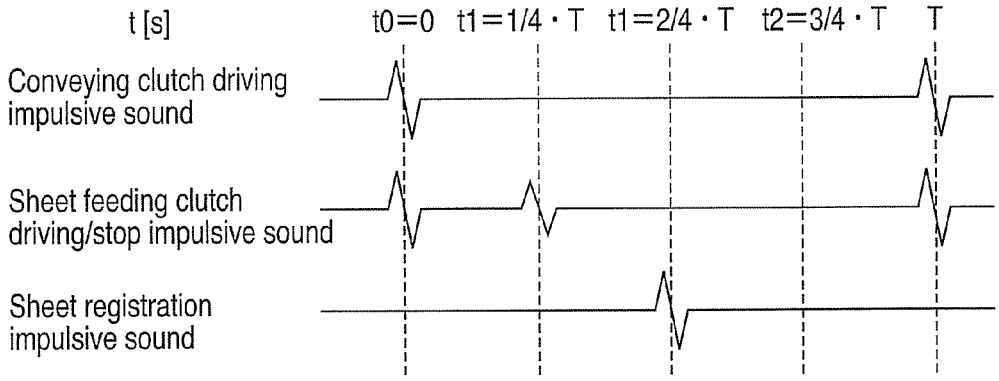
FIG. 19C is a timing chart showing a timing of the impulsive sound being caused in the sheet conveying apparatus according to a second modification of Example 2.

In a sheet conveying apparatus according to the second modification, changes are made to $\alpha_1=0$, $\alpha_2=0$, $\alpha_3=1$, and $\alpha_4=2$. That is, as shown in FIG. 19C, at time t=0, the sheet conveying clutch 15 is driven and also the sheet feeding clutch 14 is driven so that impulsive sounds are caused. Next, at time t=T/4, the sheet feeding clutch 14 is stopped and an impulsive sound is caused and at time t=2T/4, the tip of the conveyed sheet 10 collides against the registration roller pair 4 to cause an impulsive sound. In this case, the conveyance distances $L_1$ to $L_4$ are determined as $-210$ [mm]$<L_1<0$ [mm], 0 [mm] $<L_2=L_3<80$ [mm], and $L_4=160$ [mm] from Formulas 2 to 5.

Figure 19D:
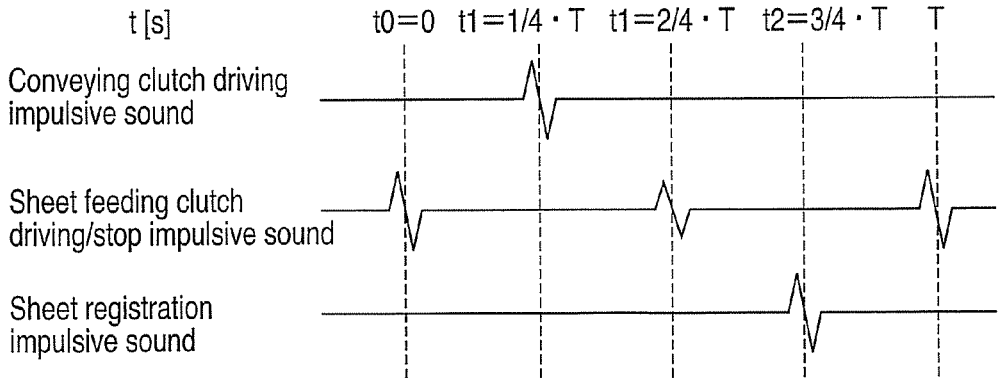
FIG. 19D is a timing chart showing a timing of the impulsive sound being caused in the sheet conveying apparatus according to a third modification of Example 2.

Further, in a sheet conveying apparatus according to the third modification, changes are made to $\alpha_1=0$, $\alpha_2=1$, $\alpha_3=2$, and $\alpha_4=3$. That is, as shown in FIG. 19D, at time t=0, the sheet feeding clutch 14 is driven and an impulsive sound is caused. Next, at time t=T/4, the sheet conveying clutch 15 is driven and an impulsive sound is caused, at time t=2T/4, the sheet feeding clutch 14 is stopped and an impulsive sound is caused, and at time t=3T/4, the tip of the conveyed sheet 10 collides against the registration roller pair 4 to cause an impulsive sound. In this case, the conveyance distances $L_1$ to $L_4$ are determined as $-210$ [mm]$<L_1<0$ [mm], 80 [mm] $<L_2=L_3<80$ [mm], and $L_4=240$ [mm] from Formulas 2 to 5.

In the sheet conveying apparatus according to the third embodiment, as described above, a method of determining the arrangement of components causing an impulsive sound is provided so that impulsive sounds are caused at the timing obtained by equally dividing the sheet feed time interval T into n. By configuring a sheet conveying apparatus according to the arrangement method, impulsive sounds may have a rhythm, and working sounds of the apparatus can be improved.

Fourth Embodiment

Figure 20:
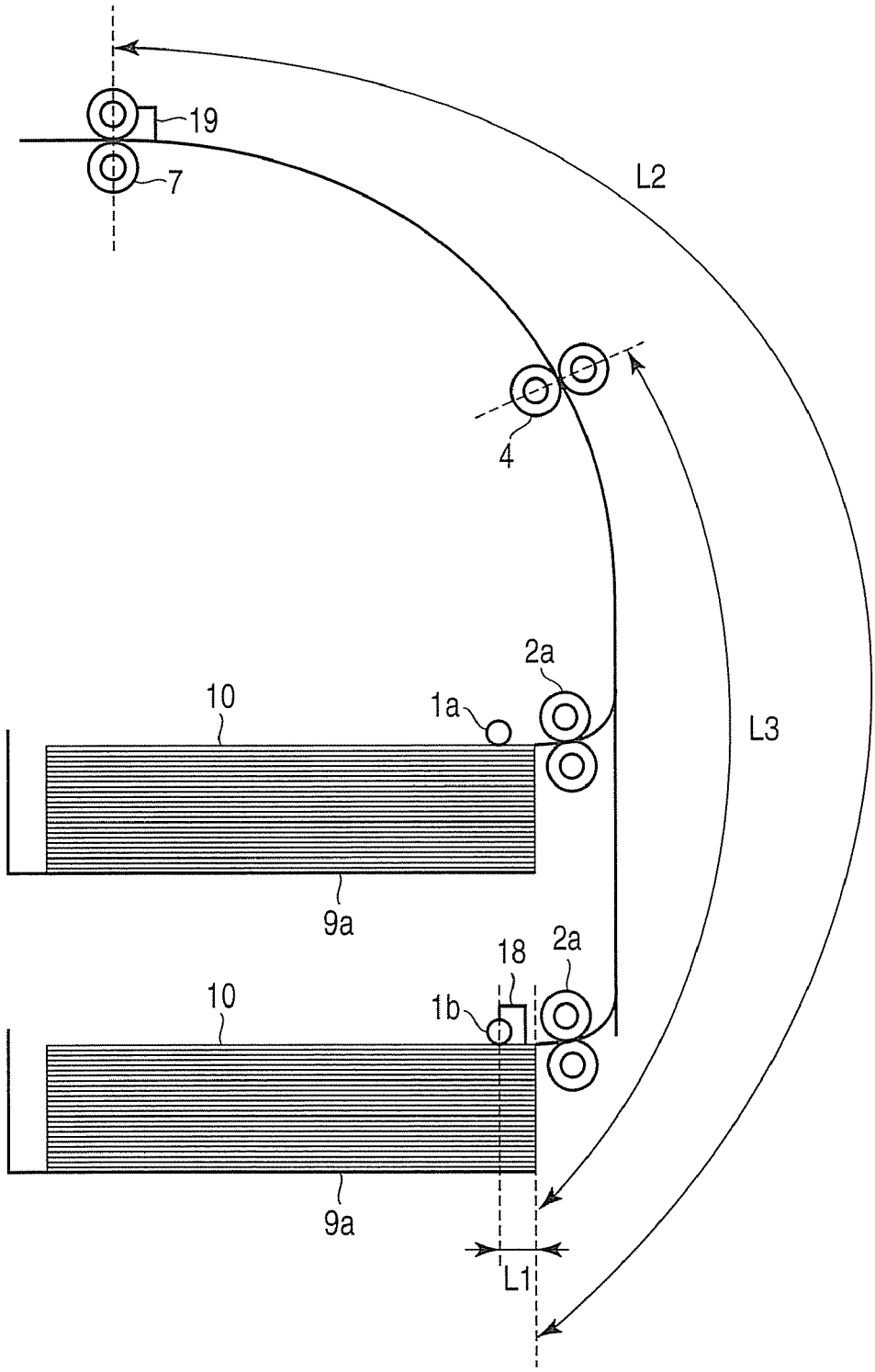
FIG. 20 is a schematic diagram more concretely showing an example of the sheet conveying mechanism from the sheet feeding cassette to the delivery roller pair shown in FIG. 1.
Figure 21:
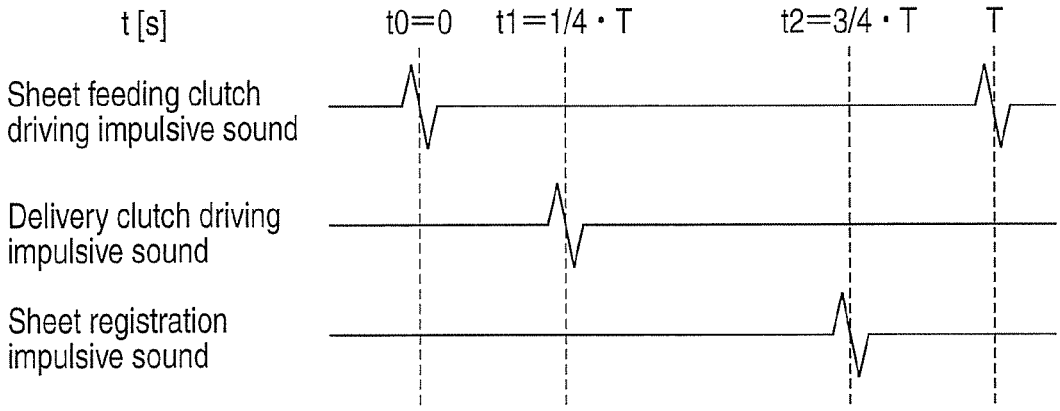
FIG. 21 is a timing chart showing a timing of the impulsive sound being caused in the sheet conveying apparatus according to Example 3 of a fourth embodiment.

A sheet conveying apparatus according to the fourth embodiment will be described with reference to FIGS. 20 and 21. FIG. 20 schematically shows a sheet conveying mechanism ranging from the sheet feeding cassette 9*b* to the delivery roller pair 7, which is a portion of the sheet conveying apparatus shown in FIG. 1. In the fourth embodiment, the arrangement of components is determined so that impulsive sounds caused between the time at which the sheet 10 is picked up from the sheet feeding cassette 9*b* and the time at which the sheet 10 passes through the delivery roller pair 7 are caused at a predetermined timing. In the description of the fourth embodiment, like the description of the third embodiment, components causing an impulsive sound do not refer to a drive unit or the like of the pickup roller 1*a* that actually causes an impulsive sound, but refer to the pickup roller 1*a* and the like arranged along the conveying path and having a drive unit that causes an impulsive sound. In the fourth embodiment, it is assumed that components causing an impulsive sound are the pickup roller 1*b*, the registration roller pair 4, and the delivery roller pair 7. Also in the fourth embodiment, the sheet conveying apparatus is designed so that the conveyance speed V becomes constant.

The pickup roller 1*b* and the sheet feeding roller pair 2*b* include a drive unit and a driving force transmission mechanism equivalent to those of the pickup roller 1*a* and the sheet feeding roller pair 2*a* shown in FIG. 8 and the pickup roller 1*b* is driven and stopped by a sheet feeding clutch 18. The delivery roller pair 7 is driven to rotate by a motor and a delivery clutch 19 at the same circumferential speed as the registration roller pair 4 or the like. Each of the sheet feeding clutch 18 and delivery clutch 19 is constituted of an electromagnetic clutch.

In the fourth embodiment, impulsive sounds to be controlled include three impulsive sounds: a drive impulsive sound caused attendant on driving the sheet feeding clutch 14, an impulsive sound caused attendant on a collision between the sheet 10 and the registration roller pair 4, and a drive impulsive sound caused attendant on driving the delivery clutch 19.

A specific value that identifies the drive impulsive sound caused by the sheet feeding clutch 18 is set as $\alpha_1$, a specific value that identifies the drive impulsive sound caused by the delivery clutch 19 is set as $\alpha_2$, and a specific value that identifies the impulsive sound caused by the registration roller pair 4 is set as $\alpha_3$.

As shown in FIG. 20, the position of the tip of the sheets 10 piled up in the sheet feeding cassette 9*b* is set as the reference of the conveyance distance along the conveying path of the sheet 10, the conveyance distance between the reference and the pickup roller 1*b* is set as $L_1$, the distance between the reference and the registration roller pair 4 as $L_3$, and the distance between the reference and the delivery roller pair 7 as $L_2$. In this case, the conveyance distance $L_1$ and the conveyance distance $L_3$ are determined according to the technique described in the third embodiment. The conveyance distance $L_2$ is determined under the condition that the first sheet of the sheet 10 is delivered by the delivery roller pair 7 before the delivery clutch 19 is driven to convey the second sheet of the sheet 10 and an impulsive sound is caused.

Therefore, the arrangement of the pickup roller 1*a*, the delivery roller pair 7, and the registration roller pair 4 is determined in such a way that the following formulas are satisfied:

$$-L_s < L_1 < 0 \tag{9}$$

$$\left(\frac{\alpha_2}{n}+1\right)TV < L_2 < \left(\frac{\alpha_2}{n}+1\right)TV + L_s \tag{10}$$

$$L_3 = \frac{\alpha_3}{n}TV \tag{11}$$

The right side of Formula 10 represents the condition that the delivery roller pair 7 does not change the arrangement order with adjacent rollers. Here, the initial time is set as $t_0=0$.

To deepen understanding of the sheet conveying apparatus according to the fourth embodiment, Example 3 will concretely be described.

Example 3

In Example 3, impulsive sounds to be controlled include drive impulsive sounds of an sheet feeding clutch and an delivery clutch and a impulsive sound of a collision between the sheet 10 and the registration roller pair 4. In Example 3, the sheet feed time interval T is set to 2 [s], the division number n of the sheet feed time interval to 4, the initial time $t_0$ to 0 [s], the conveyance speed V to 200 [mm/s], and the sheet length Ls to 210 [mm]. Also, $\alpha_1=0$, $\alpha_2=1$, and $\alpha_3=3$ are set. That is, as shown in FIG. 21, at time t=0, the sheet feeding clutch 18 is driven and an impulsive sound is caused. Next, at time t=T/4, the delivery clutch 19 is driven and an impulsive sound is caused and at time t=3T/4, the tip of the conveyed sheet 10 collides against the registration roller pair 4 to cause an impulsive sound. In this case, the conveyance distances $L_1$ to $L_3$ are determined as $-210$ [mm]$<L_1<0$ [mm], 500 [mm] $<L_2<710$ [mm], and $L_3=300$ [mm].

By determining the arrangement of the pickup roller 1*b*, the delivery roller pair 7, and the registration roller pair 4 according to these conveyance distances $L_1$ to $L_3$, a sheet conveying apparatus can be configured so that impulsive sounds are caused at times determined based on the timing obtained by equally dividing the sheet feed time interval T into n to reduce discomfort due to noise.

In the sheet conveying apparatus according to the fourth embodiment, as described above, a method of arranging components (mechanical elements) causing impulsive sounds between sheet feeding and delivery in the body unit U1 is provided. By arranging each component according to the arrangement method, a sheet conveying apparatus can be configured so that impulsive sounds are caused at the timing obtained by equally dividing the sheet feed time interval.

Fifth Embodiment

Next, a sheet conveying apparatus according to the fifth embodiment will be described. In the sheet conveying apparatus according to the fifth embodiment, the conveyance speed V is specified by an operator through the control panel 102 and the division number n is changed in accordance with the specified conveyance speed V. In one example, if selectable transfer modes are prepared in the sheet conveying apparatus, the conveyance speed V may be determined based on the transfer mode selected by the operator. The transfer modes include a fine image transfer mode and the like.

The fifth embodiment has the same configuration as the third embodiment and impulsive sounds to be controlled include impulsive sounds attendant on driving and stopping a sheet feeding clutch and an impulsive sound due to a collision between the sheet 10 and the registration roller pair 4. In the fifth embodiment, as shown in FIG. 17, the position of the tip of the sheet 10 piled up in the sheet feeding cassette 9*a* is set as the reference and the conveyance distance $L_1$ between the reference and the pickup roller 1*a*, the conveyance distance $L_2$ between the reference and the intermediate conveying roller pair 3*a*, and the conveyance distance $L_4$ between the reference and the registration roller pair 4 are designed to be L1=−50 [mm], L2=50 [mm], and L4=240 [mm]. It is assumed that the sheet feed time interval T is 2 [s/sheet] and the sheet length is 210 [mm].

Figure 22A:
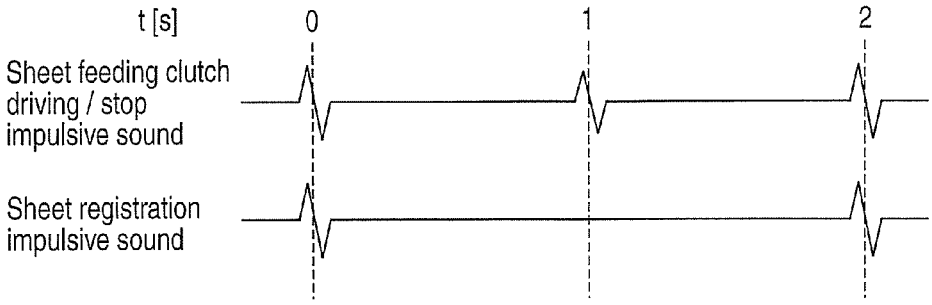
FIG. 22A is a timing chart showing an example of a timing of the impulsive sound being caused in the sheet conveying apparatus according to a fifth embodiment.
Figure 22B:
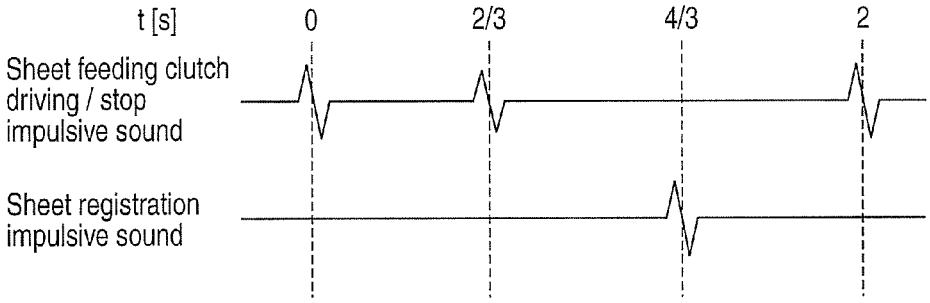
FIG. 22B is a timing chart showing another example of a timing of the impulsive sound being caused in the sheet conveying apparatus according to the fifth embodiment.
Figure 22C:
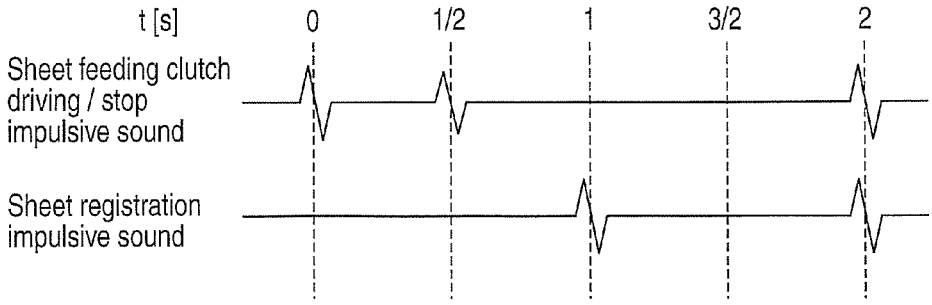
FIG. 22C is a timing chart showing a further example of a timing of the impulsive sound being caused in the sheet conveying apparatus according to the fifth embodiment.

FIGS. 22A, 22B and 22C show the timing of occurrence of impulsive sounds when the conveyance speed V is 120 [mm/s], 180 [mm/s], and 240 [mm/s]. In FIGS. 22A, 22B and 22C, the timing of causing each impulsive sound is shown by using the time when an impulsive sound is caused by driving of the sheet feeding clutch 14 as the reference time t=0 [s]. If the conveyance speed V is set to 120 [mm/s], as shown in FIG. 22A, the control device 209 controls the timing of occurrence of impulsive sounds so that an impulsive sound is caused at the timing obtained by dividing the sheet feed time interval T into two. In this case, at time t=0 [s], the first sheet of the sheet 10 is caused to collide against the registration roller pair 4 and an impulsive sound is caused and at the same time, the sheet feeding clutch 14 is driven to pick up the following second sheet 10 and an impulsive sound is caused. Next, at time t=1 [s], the sheet feeding clutch 14 is stopped and an impulsive sound is caused. At time t=2 [s], the sheet feeding clutch 14 is driven to pick up the following third sheet 10 and an impulsive sound is caused and also the second sheet 10 is caused to collide against the registration roller pair and an impulsive sound is caused. Thus, when the conveyance speed V is set to 120 [mm/s], control is exercised so that impulsive sounds are caused in a rhythm obtained by dividing the sheet feed time interval into two.

If the conveyance speed V is set to 180 [mm/s], as shown in FIG. 22B, the control device 209 controls the timing of occurrence of impulsive sounds so that an impulsive sound is caused at the timing obtained by dividing the sheet feed time interval T into three. At time t=0 [s], the sheet feeding clutch 14 is driven and an impulsive sound is caused and at time t=2/3 [s], the sheet feeding clutch 14 is stopped and an impulsive sound is caused. Further, at time t=4/3 [s], the sheet 10 is caused to collide against the registration roller pair and an impulsive sound is caused. Thus, when the conveyance speed V is set to 180 [mm/s], control is exercised so that impulsive sounds are caused in a rhythm obtained by dividing the sheet feed time interval into three.

If the conveyance speed V is set to 240 [mm/s], as shown in FIG. 22C, the control device 209 controls the timing of occurrence of impulsive sounds so that an impulsive sound is caused at the timing obtained by dividing the sheet feed time interval T into four. At time t=0 [s], the sheet feeding clutch 14 is driven and an impulsive sound is caused and at time t=1/2 [s], the sheet feeding clutch 14 is stopped and an impulsive sound is caused. Further, at time t=1 [s], the sheet 10 is caused to collide against the registration roller pair and an impulsive sound is caused. In this case, no impulsive sound is caused at time t=3/2 [s]. Thus, when the conveyance speed V is set to 240 [mm/s], control is exercised so that impulsive sounds are caused in a rhythm obtained by dividing the sheet feed time interval into four.

As described above, the timing of occurrence of impulsive sounds is controlled by the division number n of the sheet feed time interval being changed in accordance with the specified conveyance speed. The exemplary method of controlling the timing of occurrence of impulsive sounds will be described in detail when the sixth embodiment is described.

Incidentally, the division number n may be specified by the operator through the control panel 102 so that the conveyance speed is changed in accordance with the division number n. If different kinds of the sheets 10 are housed in a plurality of sheet feeding cassettes (for example, sheet feeding cassettes 9*a* and 9*b*), the operator can recognize that the sheets 10 for which a print instruction has been issued is output based on the division number n by specifying the division number n for each sheet feeding cassette, that is, each kind of sheet in advance. Further, the sheet conveying apparatus shown in FIG. 1 may include a detection sensor (not shown) that detects whether any operator is present therearound so that the division number is specified in accordance with whether any operator is present therearound.

Moreover, the division number n may be set in accordance with the language or the name of the country where the sheet conveying apparatus is used. Alternatively, the division number n may be set in accordance with the number of copies printed continuously or printing frequency when appropriate.

Thus, in a sheet conveying apparatus according to the fifth embodiment, the rhythm of working sounds can be changed in accordance with the usage environment and purpose and therefore, discomfort due to working sounds can be reduced.

Sixth Embodiment

FIG. 23 shows a control procedure for controlling impulsive sounds by the control device 209 configured to control the sheet conveying apparatus shown in FIG. 1. The control of components (mechanical elements) causing impulsive sounds described above will be described with reference to FIG. 23.

First, a sheet conveyance period is determined in step S201 and the impulsive sound occurrence time in step S200.

Figures 24, 25, 26:
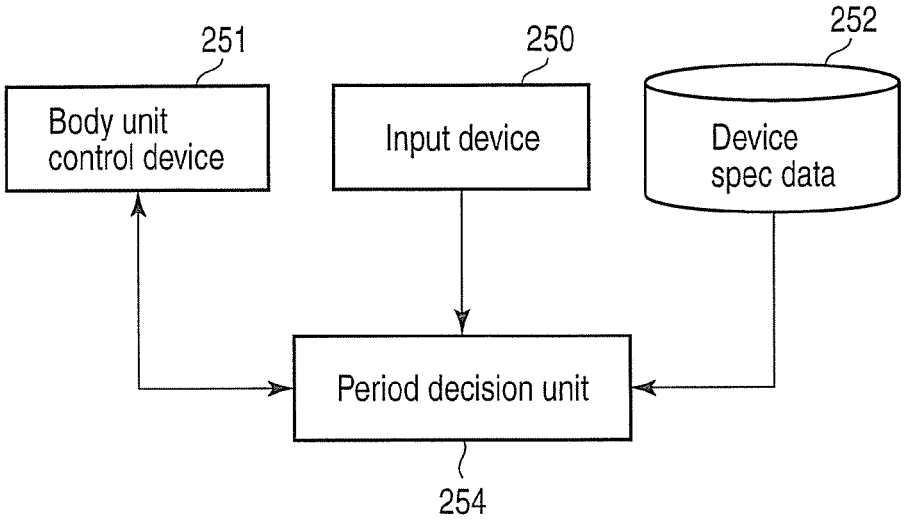
FIG. 24 is a block diagram showing a processing unit that realizes sorting of the impulsive sounds as shown in FIG. 23.
FIG. 25 is a table showing a conveyance cycle identified by an index stored in apparatus spec data shown in FIG. 24.
FIG. 26 is a table showing an impulsive sound occurrence time identified by the index stored in the apparatus spec data shown in FIG. 24.

The sheet conveyance period has the same meaning of the sheet feed time interval, and is decided by a period decision unit 254 shown in FIG. 24 based on the sheet size, apparatus performance, apparatus operating conditions (such as energy saving mode) and the like. If a plurality of selectable sheet conveyance periods are prepared in apparatus spec data 252 shown in FIG. 24 in advance. The sheet size and the number of sheets are selected through an input device 250 provided in the body unit U1 shown in FIG. 1, and the conveyance speed (low-speed conveyance attendant on the selection of low-speed fixing for a thick sheet) is selected as an option, the apparatus spec data 252 is referenced to decide selectable sheet conveyance periods by the period decision unit 254. As an example, sheet conveyance periods as shown in FIG. 25 are stored as the apparatus spec data 252 together with indexes. The sheet conveyance periods are displayed in a display unit, for example, in a display unit of the control panel 102 together with indexes when necessary and may be selected through the input device 250. If the body unit has a body unit control device 251, the selected sheet conveyance period is provided from the period decision unit 254 to the body unit control device 251 of the body unit U1 and the body unit U1 can be controlled in a state suitable for the decided sheet conveyance period.

The sheet conveyance period may be incorporated as a preset condition into a program that performs a transfer operation after the sheet size, the number of sheets and the like are selected. Alternatively, the sheet conveyance period may directly be input by using the input device. The sound element list file shown in FIG. 10 is stored in the apparatus spec data 252.

The impulsive sound occurrence time shown in step S200 is stored in the apparatus spec data 252 as a time within the selected sheet conveyance period, such as 0 [s], 0.67 [s], and 1.33 [s] at which to cause a sound. FIG. 26 shows the data format of the impulsive sound occurrence time, the left column thereof indicates the order of occurrence of impulsive sounds and the right column thereof indicates the time at which the impulsive sound is output as a relative time from the sheet conveyance period. Data of the impulsive sound occurrence time may be registered, like the sheet conveyance period, with a transfer execution program in advance. Alternatively, the impulsive sound occurrence time may directly be input by using the input device.

Figures 27, 28, 29:
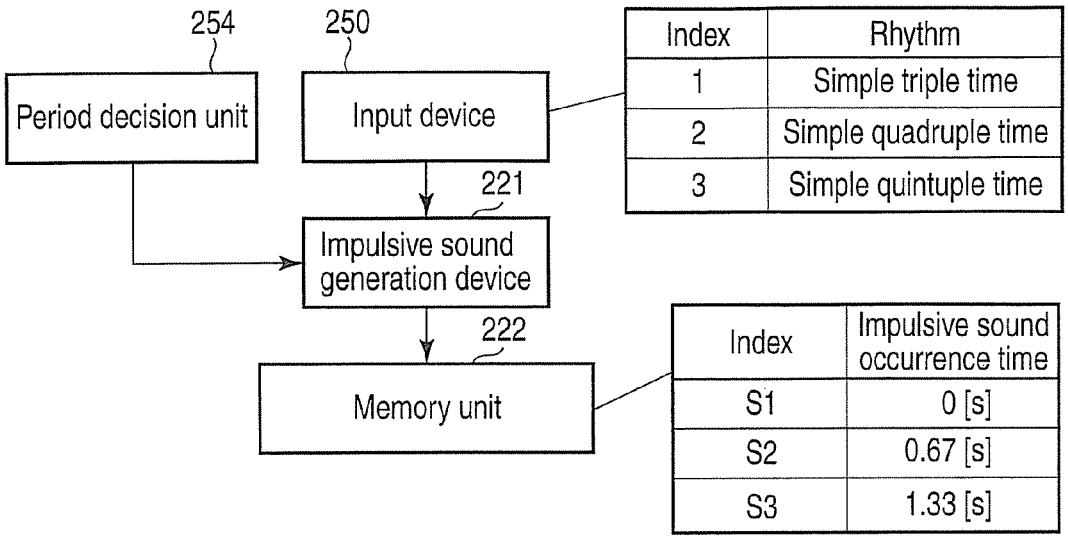
FIG. 27 is a block diagram showing the processing unit that realizes processing to generate the impulsive sound as shown in FIG. 23.
FIG. 28 is a table showing a sound element index identified by an impulsive sound index stored in a memory unit shown in FIG. 27.
FIG. 29 is a constraint condition table describing constraint conditions when the impulsive sound is sorted as shown in FIG. 23.

When the impulsive sound occurrence time is decided, as shown in FIG. 27, the rhythm (beat) such as the simple triple time, simple quadruple time, and simple quintuple time is displayed in the control panel (also called a touch panel) 102 mounted on the MFP together with indexes and the rhythm can be selected through the index by using the input device 250, for example, the touch panel. The rhythm data shown in FIG. 27 is stored in the apparatus spec data 252 together with indexes and displayed after being read based on the rhythm selection from the input device 250. The selected rhythm is sent to an impulsive sound generation device 221 to generate impulsive sound occurrence times by dividing the sheet conveyance period, which is decided by the period decision unit 254, by the division number n (or the number of rhythms). The generated impulsive sound occurrence times are stored in a memory unit 222. In a process in which the sheet conveyance period is divided by the division number n, it is not necessary to physically correctly divide the time equidistantly and times of timing that does not create a sense of discomfort as a rhythm for the auditory sense can be specified.

If, as an example, the sheet conveyance period is four seconds and the simple quadruple time (n=4) is specified from the input device, the simple time becomes one second and the indexes are set as follows:

Index 1 0 [s]
Index 2 1 [s]
Index 3 2 [s]
Index 4 3 [s]

The above data is prepared and stored in the memory unit 222.

If, as another example, the sheet conveyance period is two seconds and the simple triple time is specified from the input device, the simple time becomes 0.67 s or 0.66 s and the indexes are set as follows:

Index 1 0 [s]
Index 2 0.67 [s]
Index 3 1.33 [s]

The above data is prepared and stored in the memory unit 222.

Regardless of whether 0.67 s or 0.66 s is adopted, the user can feel a rhythm as the simple triple time without a sense of discomfort for the auditory sense.

After the sheet conveyance period and impulsive sound occurrence times are decided as described above, as shown in step S202 in FIG. 23, the impulsive sound occurrence times are sorted to sound elements. In step S202, an impulsive sound list S206 in which the impulsive sound list file shown in FIG. 10 is stored is referenced to select a plurality of forms in which impulsive sound occurrence times are sorted to sound elements. One form is selected from the plurality of forms with reference to constraint conditions S207 and, as shown in step S211, the selected form is output as time-operation sound correspondence information and stored in a memory. The constraint conditions S207 include a condition that the selection of sound elements are limited to sound elements Rn to be rhythm-controlled, a condition that sound elements appear in the occurrence order of the sound elements R1 to Rn, and a condition that different sound elements can be sorted to the same time and caused to appear simultaneously and one piece of the time-operation sound correspondence information indicating association between times and sound elements matching the constraint conditions S207 is selected.

The time-operation sound correspondence information S211 shows the correspondence between impulsive sound occurrence times and sound elements (category belonging to rhythm control) of impulsive sounds whose occurrence timing can be controlled and which cannot be eliminated in the sound element list S206. As shown in FIG. 28 as an example, the time-operation sound correspondence information S211 describes how sound elements R1, R2, R3, R4, and R5 that can be rhythm-controlled are allocated to three times, S1, S2, and S3, described for the impulsive sound index. In the example shown in FIG. 28, sounds of the sound elements R1, R2, and R3 that can appear at the same time are allocated to time S1, a sound of the sound element R4 to time S2, and a sound of the sound element R5 to time S3.

As described above, if the time difference between sound occurrences is about 50 to 200 [ms], a sound originating from a plurality of sources is recognized as a plurality of sounds. Thus, when sounds of the sound elements R1, R2, and R3 that can appear simultaneously at time S1 are allocated, the time difference of 50 to 200 [ms] is considered as a constraint condition and control is exercised so that sounds appear from the sound elements R1, R2, and R3 within the time difference.

When sounds appear in the simple n-ple time, it is preferable that the timing shifts from points in time obtained by the n division be similarly within the range. That is, even if sounds are not caused at points in time obtained by correct n division, the user can recognize that sounds are caused in the simple n time if sounds whose timing is shifted within the range of the time difference of at least 200 [ms], preferably 50 [ms] are caused. Therefore, it is assumed herein that the meaning of points in time of n division includes an error in the range of the time difference of at least 50 to 200 [ms]. Alternatively, as described above, the user can recognize that sounds are caused in the simple n-ple time even if sounds are caused by being shifted within the range of 5% of the time interval from points in time obtained by n division.

In the constraint conditions S207 shown in FIG. 23, constraint conditions for the sound element indexes R1 to R5 shown in FIG. 28 are stored. An example of the constraint conditions S207 is shown in FIG. 29. As shown in FIG. 29, there are four constraint conditions, C1 to C4. The constraint condition C1 means that the sound element R4 is caused to appear after the sound element R3, the constraint condition C2 means that the sound element R5 is caused to appear after the sound element R4, the constraint condition C3 means that the sound element R4 is caused to appear after the sound element R2, and the constraint condition C4 means that the sound element R1 and the sound element R3 are caused to appear at the same time. If these constraint conditions should be fulfilled and the impulsive sound indexes S1 to S3 are provided, the impulsive sound index S3 corresponds to the sound element R5, the impulsive sound index S2 to the sound element R4, and the impulsive sound index S1 to the sound elements R1, R2, and R3 so that these constraint conditions are satisfied.

Constraint conditions are preset and, decided depending on the arrangement or operation of the apparatus. For example, the sound element R1 and the sound element R2 are, as shown in FIG. 7, arranged in parallel and thus, there is no specific constraint of prior/subsequent relations therebetween and the sound element R1 and the sound element R3 are determined to appear almost at the same time from the time between the time at which the solenoid 306 is turned on and the time at which the pickup roller 1*a* comes into contact with the sheet 10. The sound element R3 and the sound element R4 concern ascent/descent of the same component and thus, it is clear that these sound elements cannot be caused at the same time. It is also clear that the sound element R4 and the sound element R5 cannot be caused at the same time. It is necessary for the tip of the sheet 10 to reach the position of the registration roller pair 4 when the sound element R5 appears, but in a state after the sound element R3 appears and before the sound element R4 is caused, the pickup roller 1*a* comes into contact with the sheet 10 on the sheet feeding cassette 9*a*. The distances L11, L12, and L13 shown in FIG. 7 are related by (L11+L12)>L13 and thus, if the tip of the sheet 10 positioned at the top of the sheet feeding cassette 9*a* reaches the registration roller pair 4 and the pickup roller 1*a* starts to convey the second sheet of the sheet 10 from the top of the sheet feeding cassette 9*a*, double feeding arises. The constraint condition regarding the sound element R4 and the sound element R5 is different depending on lengths of the distances L11 to L14 and these constraint conditions are met for a conveying mechanism of L11=100 mm, L12=140 mm, L13=210 mm, and L14=20 mm. That is, if the arrangement of the conveying mechanism is different, constraint conditions are different, but the distances L11 to L14 related to other structural conditions can be handled by suitably deciding the constraint conditions S207.

Figure 30:
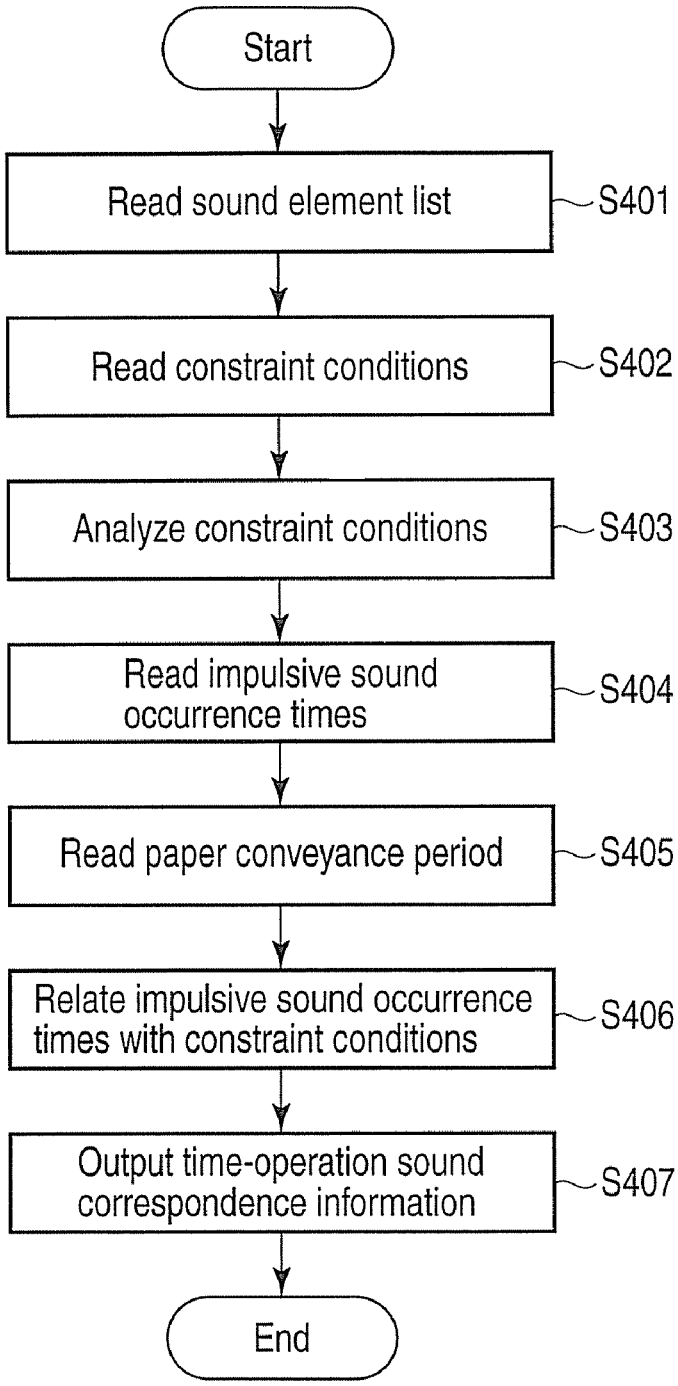
FIG. 30 is a flowchart showing the procedure for generating an operation command shown in FIG. 23.

The impulsive sound sorting S202 is performed according to an operation flow that sorts impulsive sounds shown in FIG. 30. First, in step S401 shown in FIG. 30, a sound element list is read to extract sound elements Rn whose category is the rhythm control. Next, in step S402, the constraint conditions S207 are read. These constraint conditions are analyzed in step S403 to decide order relations of sound elements Rn. Then, the impulsive sound occurrence times S200 shown in FIG. 23 are read in step S404 and next, the sheet conveyance period S201 shown in FIG. 23 is read in step S405. In step S406, the impulsive sound occurrence times are allocated to the sound elements Rn so that the constraint conditions are satisfied and lastly, in step S407, time-operation sound correspondence information is output before the processing is terminated.

When, as shown in FIG. 23, the time-operation sound correspondence information S211 is decided, in step S203, an operation command for a drive source S204, which is a control target of sound elements, is generated.

In the operation command generation device S203, operation start time commands of the solenoid 306 and the clutches 304 and 305 to cause the sound elements R1, R2, and R3 are set.

In the generation of the operation commands, constraint conditions S208 are taken into consideration. When an operation command is provided to the drive source S204 such as the solenoid 306, the motor 303, the clutches 304 and 305, the conveying motor 302, and the registration motor 301, there is a lag time before actual driving and the lag time constitutes one of the constraint conditions S208. The time at which an operation command is issued is decided by taking the lag time into consideration.

The constraint conditions S208 store physical characteristics of drive sources to cause a sound precisely at the operation time. Such physical characteristics include a delay until an impulsive sound is caused after a solenoid operation command is issued due to the inertia of the solenoid 306 and the pickup roller 1*a* and a delay until an impulsive sound is caused after a connection command of the clutch 304 or 305.

After the operation commands are generated in step S203, in step S212, an operation command program is stored in the memory of the control device 209. The operation command program contains the time at which an operation command is provided to the drive source S204 to be controlled and, if the component is a motor, settings of the motor speed at each time. The operation commands are provided to the drive sources S204, as an example, at the timing shown in FIG. 31(*f*) to (*i*), described later, to operate components at the timing shown in FIG. 31(*a*) to (*e*).

The drive sources S204 are operated based on the operation commands S212 to activate each component such as a roller shown in S205. For operations of the drive sources S204, as shown in step S213, preset driving condition parameters are referenced. In the example shown in FIG. 31, an operation command to a motor is provided as a control start (on) signal and a control stop (off) signal, but to actually drive the motor, it is necessary to decide various conditions such as the rotational speed of the motor, rising acceleration, and falling acceleration. These driving conditions can separately be set as driving condition parameters S213. For example, these parameters may be input by switching of a DIP switch on a motor drive circuit board and if a motor control device 351 is a dedicated controller such as a servo pack, a motor 354 can be driven by setting data to the dedicated controller. SGDF-A2CPY31 (SIGMA) is an example of the servo pack.

Figure 32:
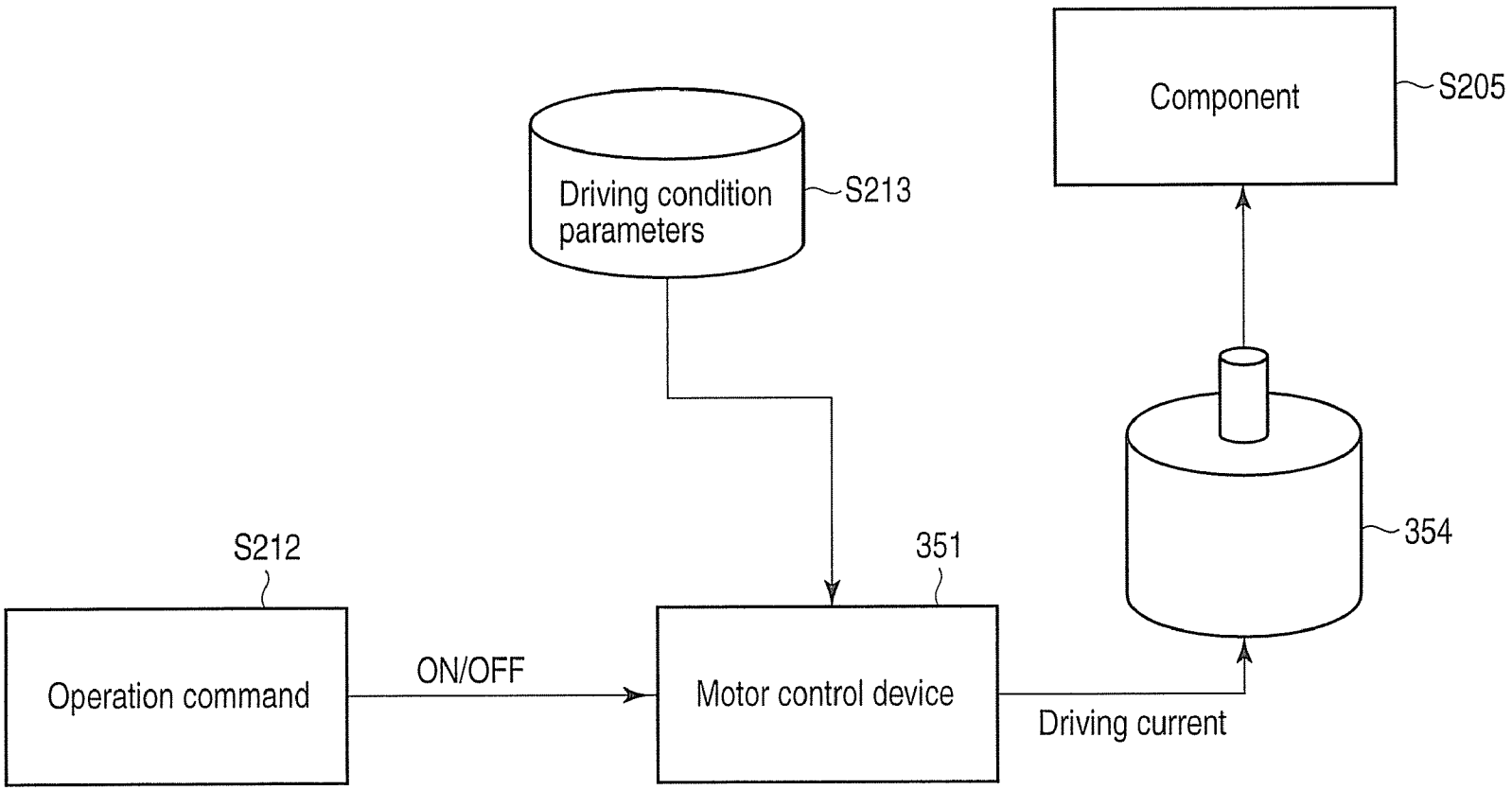
FIG. 32 is a block diagram showing a motor controller that controls a motor in the sheet conveying mechanism shown in FIG. 7.

In the motor control circuit shown in FIG. 32, when the time at which the motor 354 corresponding to one of the motors 303, 301, and 302 and the motor speed thereof are provided as the operation command in step S212, the motor control device 351 starts the control to drive the motor 354 by referencing the driving condition parameters S213. A driving current is supplied to the motor 354, which starts to rotate. The pickup roller 1*a*, the sheet feeding roller pair 2*a*, the conveying roller pair 3*a*, and the registration roller pair 4 corresponding to components connected to the motor 354 are activated simultaneously or sequentially.

For the driving condition parameters S213, if the conveying roller pair 3*a* is rotated at the same circumferential speed as the sheet feeding roller pair 2*a* to eliminate the sound element D2 below an ignorable level after the sheet conveyance period is determined and impulsive sound occurrence times are determined, a case in which (1) the sheet 10 reaches the registration roller pair 4 earlier than the desired time or (2) the sheet 10 does not reach the registration roller pair 4 at the desired time may arise. In such a case, a command to gradually decrease the speed for (1) or to gradually increase the speed for (2) is provided in the operation command S212 together with the initial speed of the motor 354 and the driving condition parameters S213 are referenced to control the motor 354 as described below.

(1) When the sheet reaches the registration roller pair 4 earlier than the desired time when the conveying roller pair 3*a* is rotated in the same circumferential speed as the sheet feeding roller pair 2*a*, if the circumferential speed of the sheet feeding roller pair 2*a* is V0 and the desired time between the time at which the sheet tip reaches the conveying roller pair 3*a* and the time at which the sheet tip reaches the registration roller pair 4 is t, the rotational speed of the conveying roller pair 3*a* is controlled in such a way that, after the conveying roller pair 3*a* starts to rotate at the circumferential speed V0 at time t0 when the tip of the sheet 10 is drawn, the integral of the circumferential speed V of the conveying roller pair 3*a* when the time t elapses after the time t0 becomes L11. L11 is, as clearly shown in FIG. 7, the conveyance distance on the conveying path from the conveying roller pair 3*a* to the registration roller pair 4.

Figure 33:
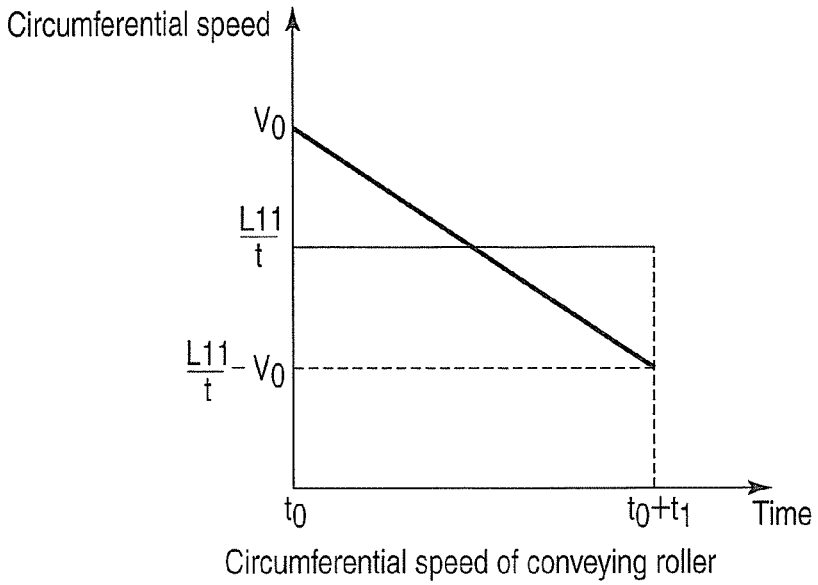
FIG. 33 is a graph exemplifying control of the conveying roller set as drive condition parameters shown in FIG. 32.

As an example, as shown in FIG. 33, there is a method of driving and controlling the conveying roller pair 3*a* in which the conveying roller pair 3*a* is rotated at the circumferential speed (L11/t−V0) at time (t0+t1) when the tip of the sheet 10 reaches the registration roller pair 4 and the change in speed (acceleration) between time t0 and time (t0+t1) is constant.

(2) When the sheet does not reach the registration roller pair 4 at the desired time when the conveying roller pair 3*a* is rotated in the same circumferential speed as the sheet feeding roller pair 2*a*, if the circumferential speed of the sheet feeding roller pair 2*a* is V0 and the desired time between the time at which the tip of the sheet 10 reaches the conveying roller pair 3*a* and the time at which the sheet tip reaches the registration roller pair 4 is t, the rotational speed of the conveying roller pair 3*a* is controlled in such a way that the conveying roller pair 3*a* is rotated at the circumferential speed V0 between the time t0 at which the tip of the sheet 10 is drawn and the time (t0+(L13−L12)/V0) at which the rear end of the sheet 10 passes through the sheet feeding roller pair 2*a* and the integral of the circumferential speed of the conveying roller pair 3*a* when the time t elapses after the time t0 becomes L11.

Figure 34:
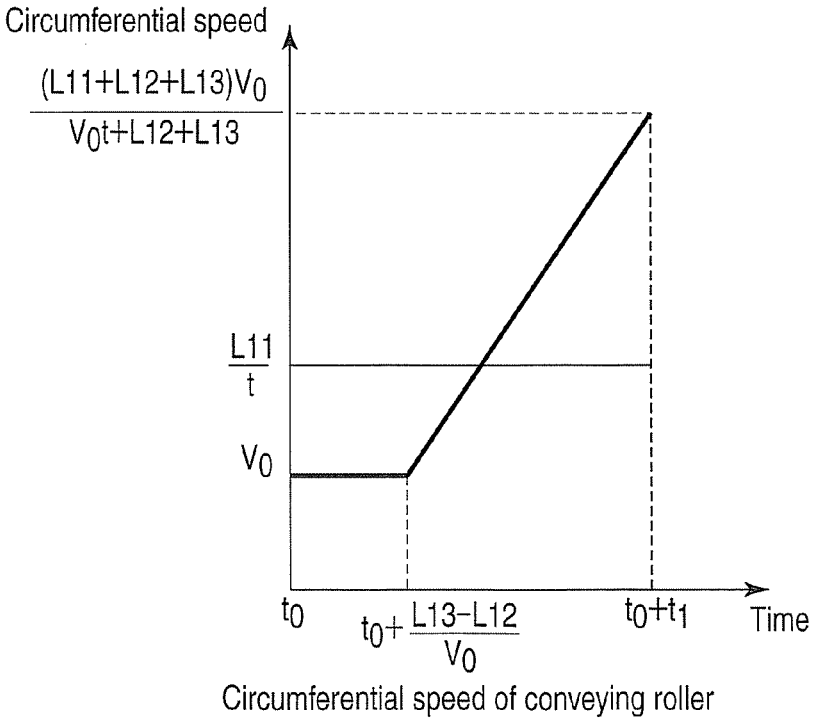
FIG. 34 is a graph exemplifying control of the conveying roller set as drive condition parameters shown in FIG. 32.

As an example, as shown in FIG. 34, the conveying roller pair 3*a* is controlled in such a way that the circumferential speed of the conveying roller pair 3*a* reaches {(L11+L12+L13)V0/(V0*t*+L12+L13)} at time (t+t0) at which the tip of the sheet 10 reaches the registration roller pair 4 and the change in speed (acceleration) between the time {t0+(L13−L12)/V0} at which the rear end of the sheet 10 passes through the sheet feeding roller pair 2*a* and the time (t+t0) is constant.

Figure 31:
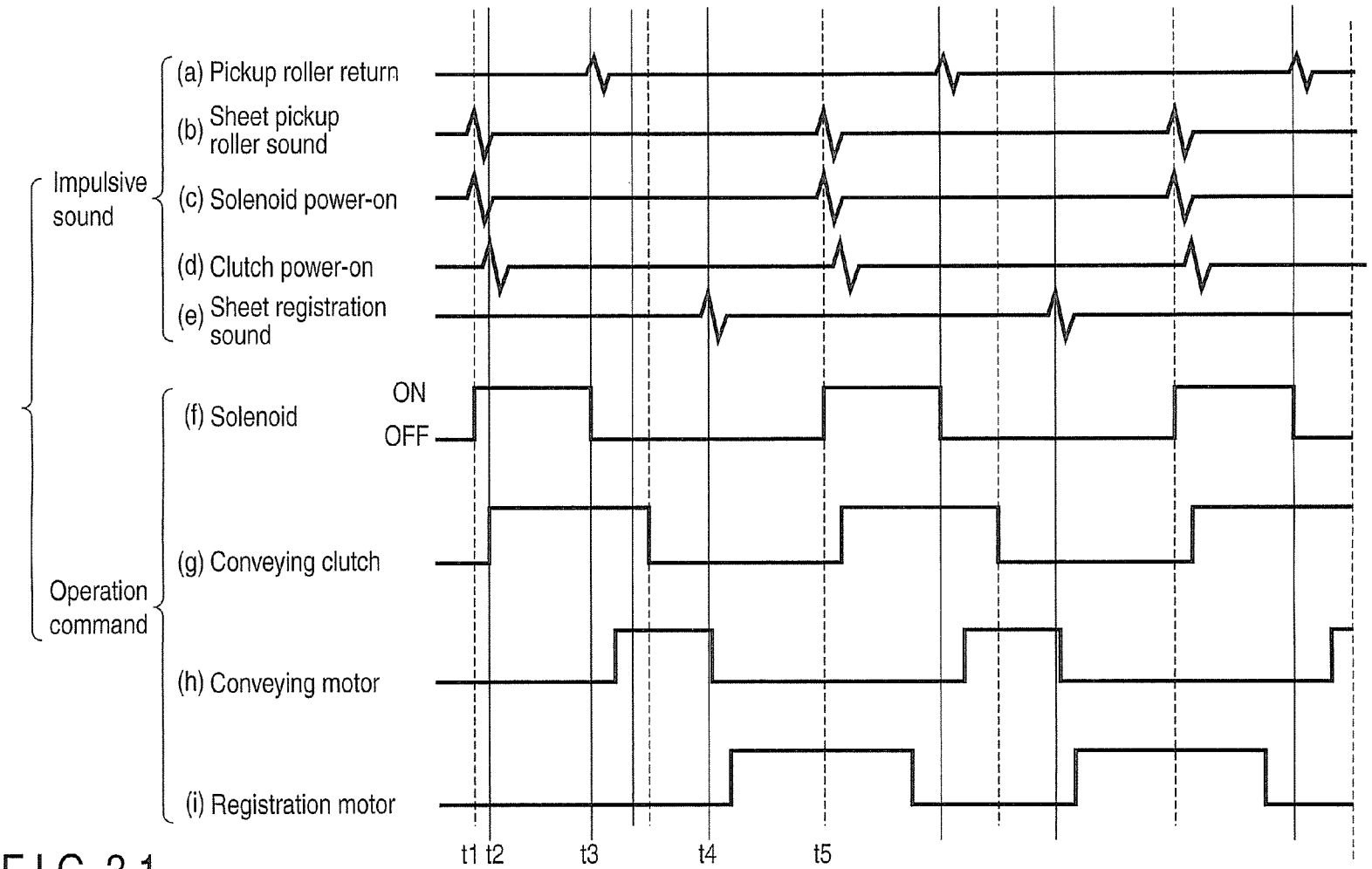
FIG. 31 is a timing chart showing an operation of each electrical/mechanical element in the sheet conveying mechanism shown in FIG. 7.

Based on an operation program generated according to the procedure shown in FIG. 23, the sheet conveying mechanism shown in FIG. 7 is operated as shown, as an example, in FIG. 31. That is, as shown in FIG. 31(*f*), the solenoid 306 is turned on at time t1 and, as shown in FIG. 31(*c*), the sound element R1 of solenoid power-on is caused. Substantially simultaneously, the sheet pickup roller 1*a* comes into contact with the sheet 10 and, as shown in FIG. 31(*b*), the sound element R3 is caused as a roller sound. If manual conveyance is selected, the conveying clutch 304 is turned off at time t2 and, as shown in FIG. 31(*g*), a manual clutch (not shown) is turned on and, as shown in FIG. 31(*d*), the sound element R2 of clutch power-on is caused.

Upon power-off of the solenoid 306 at time t3, as shown in FIG. 31(*a*), the pickup roller 1*a* or 1*c* is switched to a return operation and the sound element R3 is caused by the pickup roller as a mechanical sound during switching. After time t3, as shown in FIG. 31(*h*), driving of the conveying roller pair 3*a* is started or, for manual conveyance, as shown in FIG. 31G, a manual conveying clutch (not shown) is turned off.

The sheet 10 reaches the registration roller pair 4 at time t4 and, as shown in FIG. 28(*e*), a registration sound is caused as the sound element R5. Then, as shown in FIG. 28(*i*), the registration motor 301 is activated to convey the sheet 10 to the conveying path of the next process.

After the time t5, an operation similar to that between time t1 and time t5 is repeated. In the example shown in FIG. 31(*a*) to (*i*), the sound elements R1, R2, and R3 of the first beat are caused at time t1 and time t2. Next, the sound element R4 of the second beat is caused at time t3 and the sound element R5 of the third beat is caused at time t4. Thus, sound elements rhythmically appear from the conveyance apparatus in the simple triple time.

Various examples of a sheet conveying apparatus according to the sixth embodiment will be described below.

Example 5

The sheet feed time interval ΔT is set to two seconds and impulsive sound occurrence times are S1: 0 [s], S2: 0.67 [s], and S3: 1.33 [s].

First, in step S202 of the impulsive sound sorting shown in FIG. 23, three times of S1: 0 [s], S2: 0.67 [s], and S3: 1.33 [s] are sorted to five impulsive sounds R1 to R5. Since five sounds are sorted to three times, at least two sounds or more are caused at one time. If it is assumed that there are not two or more sheets in the apparatus, it is necessary to cause all element sounds within two seconds. In this case, under conditions that the sound elements R1, R2, and R3 can be caused simultaneously, the sound elements R3 and R4 cannot be caused simultaneously, and the sound elements R4 and R5 cannot be caused simultaneously, the correspondence between the impulsive sound occurrence time and impulsive sound, which is the output of the step of impulsive sound sorting, is decided as follows.

S1 (T0) 0 [s]: R1, R2, R3
S2 (T0) 0.67 [s]: R4
S3 (T0) 1.33 [s]: R5

Times at which a sound of the second sheet or a subsequent sheet of the sheet 10 is caused are created as follows by adding a value obtained by multiplying the number of sheets by the period.

S1 (T1) 2 [s]: R1, R2, R3
S2 (T1) 2.67 [s]: R4
S2 (T1) 3.33 [s]: R5
S1 (T2) 4 [s]: R1, R2, R3
S2 (T2) 4.67 [s]: R4
S2 (T2) 5.33 [s]: R5

Impulsive sound occurrence times continue similarly for the number of sheets.

T0, T1, and T2 are sheet conveyance start times set, such as T0=0, T1=T0+ΔT, and T2=T1+ΔT and S1 (T) is an impulsive sound occurrence time when the sheet conveyance start time T is set as a reference time.

If, as an example of the constraint conditions S208, assuming a apparatus in which the delay of an occurrence of the sound R2 after a connection command of the clutch 304 or 305 is 0.01 [s], the delay of an occurrence of the sound R1 or R3 after an operation command of the solenoid 306 is 0.10 [s], and the delay of an occurrence of the sound R4 after a stop command of the solenoid 306 is 0.07 [s], in order for the sound elements R1, R2, and R3 to be caused at 0 [s] and for the sound element R4 to be caused at 0.67 [s], commands need to be issued at the following times:

Solenoid operation command: −0.10 [s]
Solenoid stop command: 0.60 [s]
Clutch connection command: −0.01 [s]

The clutch disconnection time becomes the stop time of the sheet feeding roller pair 2*a* and thus needs to decide the time at which the tip of the sheet 10 reaches the conveying roller pair 3*a* in such a manner that the time at which the rear end of the sheet 10 passes through the sheet feeding roller pair 2*a* is later than the stop time of stopping the sheet feeding roller pair 2*a*. With this setting, double feeding of the sheets 10 can be prevented.

It is assumed here that the rotational speed of the constant-speed motor that rotates the sheet feeding roller pair 2*a* is a speed of 200 mm/s in terms of the circumferential speed of the roller. In this case, the clutch disconnection time needs to be after L12/200=0.7 [s] and before L13/200=1.05 [s]. Thus, in consideration of a disconnection delay of the clutch, the clutch disconnection time command is 0.8 [s] by adopting a value that is a little earlier than the intermediate value in units of 0.1 [s].

As described above, the time when the tip of the sheet 10 reaches the conveying roller pair 3*a* is L12/200=0.7 [s]. On the other hand, based on the occurrence time of the sound element R5, the time when the sheet 10 reaches the registration roller pair 4 needs to be 1.33 [s]. The conveying motor 302 is a motor whose speed can be controlled and if the motor is assumed to be rotated at a constant speed, the motor needs to rotate at speed of (100 mm)/((1.33−0.7)(s))=159 mm/s in terms of the circumferential speed of the conveying roller pair 3*a*. However, if the circumferential speed of the sheet feeding roller pair 2*a* is 200 mm/s and the circumferential speed of the conveying roller pair 3*a* is 159 mm/s, an impulsive sound will be caused by a collision when the tip of the sheet reaches the conveying roller pair 3*a* due to the difference of the circumferential speed. The impulsive sound is caused outside the specified times and thus, an occurrence thereof needs to be suppressed. Therefore, a speed command of the conveying roller pair 3*a* is generated in such a way that the conveying roller pair 3*a* rotates at the same circumferential speed as the sheet feeding roller pair 2*a* when the tip of the sheet reaches the conveying roller pair 3*a* and then gradually reduces speed so that the time when the sheet 10 reaches the registration roller pair 4 becomes 1.33 [s]. More specifically, as described with reference to FIG. 33, the speed command needs to be generated in such a way that an integral L of the speed between 0.6 [s] and 1.33 [s] becomes 100 mm with the initial speed of 200 mm/s. If the speed is reduced at constant acceleration, the initial speed becomes 200 mm/s and the final speed 118 mm/s. Moreover, it is actually necessary to cause the sheet 10 to have flexure by extra sending the sheet 10 after the sheet 10 reaches the registration roller pair 4 and thus, the conveying motor 302 is operated up to 1.5 [s].

Lastly, the registration roller pair 4 is rotated to send out the sheet 10 to the transfer unit. It is necessary to specify the rotational speed and the operation time in such a way that the rear end of the first sheet 10 passes through the registration roller pair 7 before the second sheet arrives the registration roller pair 7. If the rotational speed of the registration motor pair 4 is 200 mm/s in terms of the circumferential speed of the roller, the time necessary to send out the sheet to the transfer unit is 210/200=1.05 [s]. Since the second sheet reaches the registration roller pair 4 at 3.33 [s], the registration motor is rotated at a speed of 200 mm/s to send out the sheet, for example, between the time 1.8 [s] and the time 2.9 [s] within the range between the time at which the first sheet reaches the registration roller pair 4 and the time at which the second sheet reaches the registration roller pair 4.

If only the registration roller pair 4 is rotated when the sheet 10 is sent out by the registration roller pair 4, a stretching sound is caused when the flexed sheet is stretched by the registration roller pair 4. The sound is also caused outside the specified times and thus, it is necessary to rotate the conveying roller pair 3*a* at the same circumferential speed as the registration roller pair 4 until the rear end of the sheet passes through the conveying roller pair 3*a* when the registration roller pair 4 rotates to prevent an occurrence of the sound.

Example 6

In Example 5, the rotational speed of the constant-speed motor 303 that rotates the sheet feeding roller pair 2*a* is set to 200 mm/s in terms of the circumferential speed of the roller 2*a*. In Example 6, a case will be described in which the same sheet conveyance period and sound occurrence times as those in Example 5 are specified, but the rotational speed of the motor 303 that rotates the sheet feeding roller pair 2*a* is set to 170 mm/s in terms of the circumferential speed of the roller 2*a*.

Since the sheet conveyance period and sound occurrence times are the same, the correspondence between the sound occurrence time and impulsive sound is decided just like in Example 5 as follows:

0 [s]: R1, R2, R3
0.67 [s]: R4
1.33 [s]: R5

Similarly, the operation/stop command of the solenoid 306 and the connection command of the clutch 304 are set just like in Example 5 as follows:

Operation command of the solenoid 306: −0.10 [s]
Stop command of the solenoid 306: 0.60 [s]
Connection command of the clutch 304: −0.01 [s]

The time when the tip of the sheet 10 reaches the conveying roller pair 3*a* is L12/170=0.82 [s]. On the other hand, based on the occurrence time of the sound element R5 when the sheet 10 collides against the registration roller pair 4, the time when the sheet 10 reaches the registration roller pair 4 needs to be 1.33 [s]. The conveying motor 302 is a motor whose speed can be controlled and if the motor is assumed to be rotated at a constant speed, the motor needs to rotate at a speed of (100 mm)/((1.33−0.82)(s))=196 mm/s in terms of the circumferential speed of the conveying roller pair 3*a*. However, if the circumferential speed of the sheet feeding roller pair 2*a* is 170 mm/s and the circumferential speed of the conveying roller pair 3*a* is 196 mm/s, an excessive tensile strength may be applied to the sheet 10 or a frictional sound may be caused by the sheet feeding roller pair 2*a* because the sheet 10 is pulled by the conveying roller pair 3*a* due to the difference in the circumferential speed. The sound is caused outside the specified times and thus, an occurrence thereof needs to be suppressed. Therefore, a speed command of the conveying roller pair 3*a* is generated in such a way that the conveying roller pair 3*a* rotates at the same circumferential speed as the sheet feeding roller pair 2*a* until the rear end of the sheet 10 passes through the sheet feeding roller pair 2*a* from the time when the tip of the sheet 10 reaches the conveying roller pair 3*a* and then gradually picks up speed so that the time when the sheet 10 reaches the registration roller pair 4 becomes 1.33 [s].

The time when the rear end of the sheet 10 passes through the sheet feeding roller pair 2*a* is (L13+L14)/170=220/170=1.29 [s]. Specifically, the speed command needs to be generated in such a way that the speed between 0.8 [s] and 1.29 [s] is 170 mm/s and the integral of the speed becomes 16.7 mm between 0.8 [s] and 1.33 [s]. As described with reference to FIG. 33, if the speed is reduced at a constant acceleration, the initial speed becomes 170 mm/s and the final speed 665 mm/s. Moreover, it is actually necessary to cause the sheet 10 to have flexure by extra sending the sheet 10 after the sheet 10 reaches the registration roller pair 4 and thus, the conveying motor 302 is operated up to 1.5 [s].

Example 7

It is assumed in Example 5 that only one sheet 10 is present in the apparatus, but it is possible that two or more sheets are present in the apparatus. In such a case, the correspondence between the impulsive sound occurrence time and impulsive sound in impulsive sound sorting generation is set as follows:

0 [s]: R1, R2, R3
0.67 [s] R4
1.33 [s] None
2 [s] R5
2.67 [s] None
3.33 [s] None

Example 8

In this example, the sheet feed time interval is set to two seconds and impulsive sound occurrence times are 0 [s], 0.5 [s], 1.0 [s], and 1.5 [s]. In this case, there are two possibilities of sorting shown below.

(Sorting 1)
0 [s]: R1, R2, R3
0.5 [s]: R4
1.0 [s]: None
1.5 [s]: R5
(Sorting 2)
0 [s]: R2
0.5 [s]: R1, R3
1.0 [s]: R4
1.5 [s]: R5

There is also a method of generating impulsive sound occurrence times by specifying the sheet feed time interval and the period division number of operation sounds using the input device 250. If, for example, the sheet feed time interval is two seconds and the period division number is 3, impulsive sound occurrence times are 0 [s], 0.67 [s], and 1.33 [s], and if the sheet feed time interval is two seconds and the period division number is 4, impulsive sound occurrence times are 0 [s], 0.5 [s], 1.0 [s], and 1.5 [s].

Seventh Embodiment

A sheet conveying apparatus according to the seventh embodiment will be described with reference to FIG. 35. The sheet conveying apparatus according to the seventh embodiment includes a function to sense an error (or malfunction) of the sheet conveyance operation in advance of the sheet conveying apparatus controlled in such a way that impulsive sounds are caused rhythmically. As an example, when impulsive sounds N1, N2, and N3 are caused by a collision of the sheet 10 with the registration roller pair 4 as described in the second embodiment and driving of the sheet aligning paddles 150 and 151 of the finisher unit, that is, a case in which impulsive sounds are caused at the timing shown in FIGS. 15 and 16 will be described. The time interval obtained by equally dividing the sheet feed time interval (sheet conveyance period) T, i.e., the time interval at which an impulsive sound is caused will be called a timing period. In the seventh embodiment, the timing period will be T/3.

The timing period T/3 in which an impulsive sound is caused is defined within an error range described above. That is, an error range Δ is defined in such a way that the time interval between some impulsive sound and a subsequent impulsive sound becomes larger than T/5. In a sheet conveying apparatus according to the seventh embodiment, if the sheet conveying mechanism and the control system are normal, impulsive sounds are successively caused at the timing period T/3. However, if the sheet conveying mechanism or the control system fails for some reason, impulsive sounds may be caused beyond the error range Δ of the timing period T/3. Thus, a timing period t1 between the occurrence time of the impulsive sound N1 and the occurrence time of the impulsive sound N2, a timing period t2 between the occurrence time of the impulsive sound N2 and the occurrence time of the impulsive sound N3, and a timing period t3 between the occurrence time of the impulsive sound N3 and the occurrence time of the impulsive sound N1 are monitored constantly or when appropriate. More specifically, the sheet conveying apparatus is provided with a microphone (not shown) to detect the impulsive sounds N1 to N3. If at least one of the timing periods t1, t2, and t3 exceeds the error range Δ, the control panel 102 is notified of an error of the sheet conveying mechanism or the control system to call attention of the operator thereto.

Figure 35:
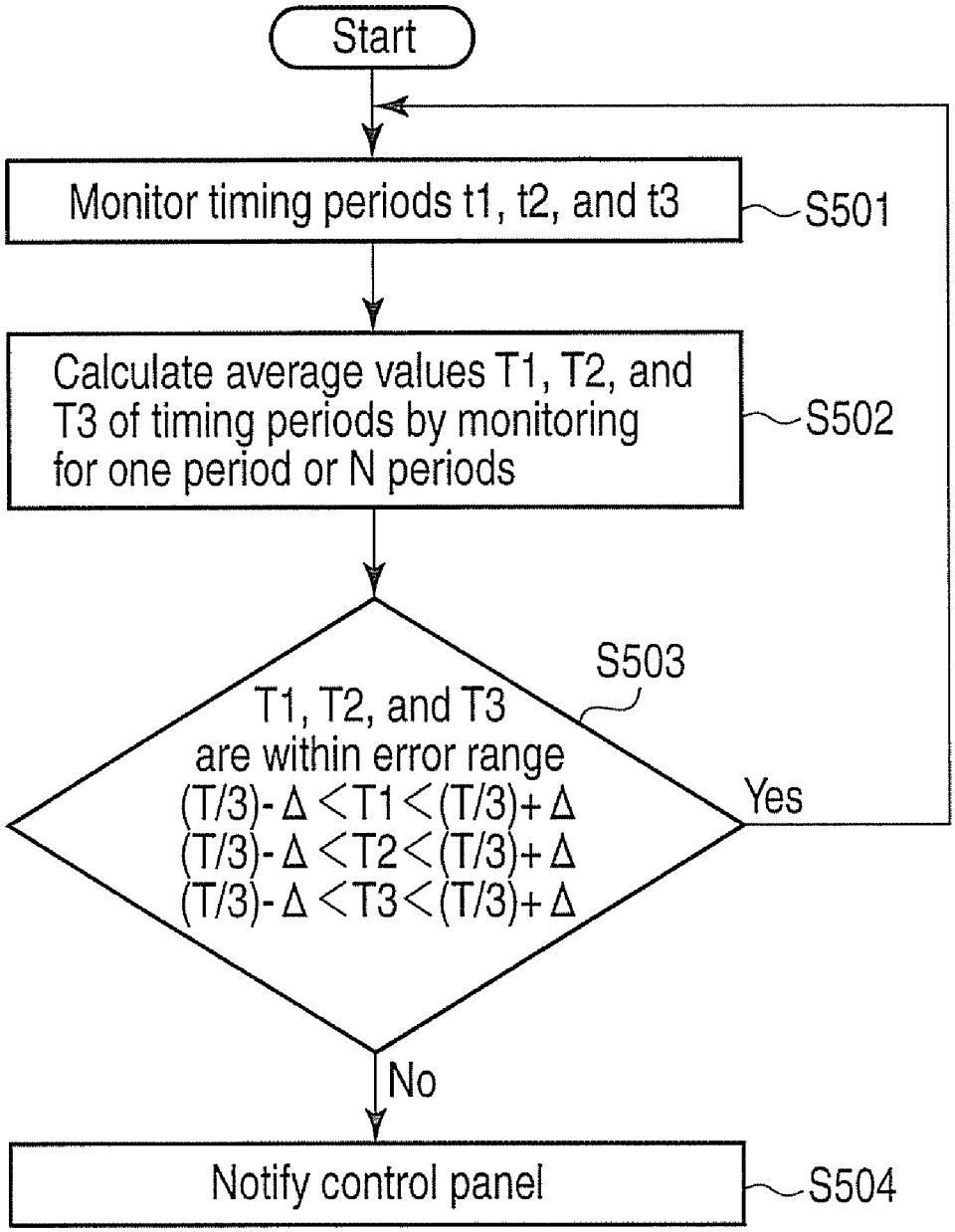
FIG. 35 is a flowchart to detect a timing cycle shift of the impulsive sound periodically caused in the sheet conveying apparatus according to a seventh embodiment.

FIG. 35 shows a flowchart to detect an error in the sheet conveying mechanism or the control system. In a sheet conveying apparatus according to the seventh embodiment, the timing periods t1, t2, and t3 are monitored in step S501. In step S502, the timing periods t1, t2, and t3 are monitored in one period or N (N is an integer of 2 or more) periods to calculate average values T1, T2, and T3 of the timing periods. In step S503, if the average values T1, T2, and T3 of the timing periods are within the error range, the processing returns to step S501 again. If at least one of the average values T1, T2, and T3 are not within the error range, as shown in step S504, the control panel 102 is notified that an error has occurred in the sheet conveying mechanism or the control system.

In the seventh embodiment, as described above, shifts in the time intervals at which impulsive sounds are caused are detected and an occurrence of a serious error can be known in advance by a notification that an error has occurred in the sheet conveying mechanism or the control system.

A sheet conveying apparatus of at least one of embodiment described above is designed to cause impulsive sounds at the timing obtained by equally dividing the conveyance time interval when a sheet is conveyed, so that a sense of abruptness of impulsive sounds attendant on sheet conveyance can be eliminated below an ignorable level, noise can be changed to unified working sounds, and discomfort for the operator of the apparatus and workers therearound can be reduced without hindering conveyance of the sheet. As a result, the sheet conveying apparatus of the embodiment can realize a product sound friendly to human environments. Further, according to certain embodiments, by monitoring the timing of occurrences of impulsive sounds, an error of the sheet conveying apparatus can be detected in advance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the MFP shown in FIG. 1, in addition to the above impulsive sounds, an impulsive sound caused by starting to drive a driving force transmission unit other than the above one or stopping the driving force transmission unit, an impulsive sound cased when a sheet collides against any other roller, conveying guide, sheet detection sensor, tray, or gate, an impulsive sound caused in the process of moving up the manual pickup roller 1*c*, aligning the sheet in the finisher unit U3, pressing down a sheet retaining lever, or conveying the sheet can be considered to be element sounds. Therefore, element sounds may be configured by combining all the above impulsive sounds or some impulsive sounds of all the impulsive sounds.

What is claimed is:

1. A sheet conveying apparatus comprising:

a conveying mechanism configured to pick up and convey a sheet every first time interval T, the conveying mechanism including a plurality of sound sources which produce a plurality of element sounds attendant on conveying the sheet; and a control unit configured to control the conveying mechanism so that the plurality of element sounds are caused at times determined based on a second time interval, wherein the second time interval is acquired by dividing the first time interval T by a division number n which is an integer of two or more.

2. The apparatus according to claim 1, wherein the division number n is two, three or four.

3. The apparatus according to claim 1, wherein the conveying mechanism comprises:

a first conveying unit configured to feed and convey the sheet, the first conveying unit having an image forming unit to form an image on the sheet and a manuscript reading unit to read a manuscript sheet to be copied;

a second conveying unit configured to sort and deliver the sheet conveyed by the first conveying unit; and a third conveying unit configured to convey the manuscript sheet to the manuscript reading unit, and the plurality of element sounds are caused by one of the first, second, and third conveyance units.

4. The apparatus according to claim 1, wherein the conveying mechanism includes:

a first conveying unit configured to feed and convey the sheet, the first conveying unit having an image forming unit to form an image on the sheet and a manuscript reading unit to read a manuscript sheet to be copied;

a second conveying unit configured to sort and deliver the sheet conveyed by the first conveying unit; and a third conveying unit configured to convey the manuscript sheet to the manuscript reading unit, and the plurality of element sounds are caused by two or more of the first, second, and third conveyance units.

5. The apparatus according to claim 1, further comprising an interface unit configured to display a state of the conveying mechanism, wherein each of the plurality of element sounds is assigned to one of the times, and when at least one of the plurality of element sounds is caused by being shifted from the assigned time by a predetermined time or more, an error is displayed in the interface.

6. The apparatus according to claim 1, wherein the conveying mechanism includes a pickup unit configured to pick up the sheet, a sheet feeding unit configured to feed the picked-up sheet to a conveying path, a conveying unit configured to convey the fed sheet along the conveying path, an aligning unit configured to align the conveyed sheet, and a delivery unit configured to deliver the conveyed sheet out of the apparatus, the plurality of sound sources include at least one of the pickup unit, the sheet feeding unit, the conveying unit, the aligning unit, and the delivery unit, and each of the plurality of element sounds is caused at a time $t_\alpha$ satisfying a relationship expressed by a formula below:

$$t_\alpha = \frac{\alpha}{n} \cdot T + t_0 \tag{101}$$

where $t_0$ denotes an initial time at which one of the plurality of element sounds is initially caused in each first time interval T, and $\alpha$ corresponds to a division point when the first time interval T is equally divided and is an integer of 0 or more and less than n.

7. The apparatus according to claim 6, wherein the conveying mechanism conveys the sheet at a constant speed V, in cases where m sheets among which the sheet is included are simultaneously conveyed, when a sequence number indicating an order of occurrence of the plurality of element sounds is set as x, a position of a tip of the sheet when the sequence number x is 1 is set as a reference position, and a conveyance distance between the reference position and the position reached by the tip of the sheet when the element sound specified by the sequence number x is caused is set as Lx, the conveyance distance Lx satisfies Formula 102 below within a range in which the sheet can be conveyed, and at least one of the pickup unit, the sheet feeding unit, the conveyance unit, and the delivery unit is arranged at a position determined by the conveyance distance Lx:

$$L_x = V \cdot [t_\alpha + (m-1) \cdot T] \tag{102}$$

where x is an integer of more than 0 and N or less, N denotes the number of the plurality of element sounds and is an integer of 2 or more, and m is a positive integer.

8. The apparatus according to claim 1, wherein the conveying mechanism comprises:

a pickup roller configured to pick up the sheet from a pile of sheets;

a first drive unit configured to drive the pickup roller;

a conveying roller configured to convey the picked-up sheet;

a second drive unit configured to drive the conveying roller; and a registration roller configured to align the conveyed sheet by causing a collision with a tip of the conveyed sheet, the conveying mechanism conveys the sheet at a constant speed V, the plurality of element sounds include a first impulsive sound caused when the first drive unit drives the pickup roller, a second impulsive sound caused when the second drive unit drives the conveying roller, a third impulsive sound caused when the first drive unit stops the pickup roller, and a fourth impulsive sound caused when the sheet collides with the registration roller, when the tip of the pile of the sheets is set as a reference position, a first distance between the reference position and the pickup roller is set as L1, a second distance between the reference position and the conveying roller is set as L2, a third distance which is identical with the second distance L2 is set as L3, a fourth distance between the reference position and the registration roller is set as L4, a length of the sheet is set as Ls, and values corresponding to division points where the second, third, and fourth impulsive sounds are caused when the first time interval T is equally divided are set as $\alpha_2$, $\alpha_3$, and $\alpha_4$, respectively, the first distance L1, the second distance L2, the third distance L3, and the fourth distance L4 satisfy Formulas 103, 104, 105 and 106 below:

$$-L_s < L_1 < 0 \tag{103}$$

$$\frac{\alpha_2}{n} TV < L_2 < \frac{\alpha_2}{n} TV + L_s \tag{104}$$

$$\frac{\alpha_3}{n} TV - L_s < L_3 < \frac{\alpha_3}{n} TV \tag{105}$$

$$L_4 = \frac{\alpha_4}{n} TV \tag{106}$$

where division points $\alpha_2$, $\alpha_3$, and $\alpha_4$ are integers of 0 or more and less than n.

9. The apparatus according to claim 1, wherein the conveying mechanism includes:

a pickup roller configured to pick up the sheet from a pile of sheets;

a first drive unit configured to drive the pickup roller;

a registration roller configured to align the sheet by being collided against a tip of the sheet and convey the aligned sheet;

a delivery roller configured to deliver the sheet out of the apparatus; and a second drive unit to drive the delivery roller, the conveying mechanism conveys the sheet at a constant speed V, the plurality of element sounds include a first impulsive sound caused when the first drive unit drives the pickup roller, a second impulsive sound caused when the second drive unit drives the delivery roller, and a third impulsive sound caused when the sheet collides with the registration roller, when the tip of the pile of the sheets is set as a reference position, a first distance between the reference position and the pickup roller is set as L1, a second distance between the reference position and the delivery roller is set as L2, a third distance between the reference position and the registration roller is set as L3, a length of the sheet is Ls, and values corresponding to division points where the second and third impulsive sounds are caused when the first time interval T is equally divided are set as $\alpha_2$ and $\alpha_3$, respectively, in cases where two sheets including the sheet are successively conveyed, the first distance L1, the second distance L2, and the third distance L3 satisfy Formulas 107, 108 and 109 below:

$$-L_s < L_1 < 0 \tag{107}$$

$$\left(\frac{\alpha_2}{n}+1\right)TV < L_2 < \left(\frac{\alpha_2}{n}+1\right)TV + L_s \tag{108}$$

$$L_3 = \frac{\alpha_3}{n}TV. \tag{109}$$

10. The apparatus according to claim 1, wherein the plurality of sound sources includes first, second, and third sound generating units which generate first, second, and third impulsive sounds as the plurality of element sounds respectively, and the conveying mechanism comprises:

a pickup unit configured to pick up the sheet every first time interval T, the pickup unit including the first sound generating unit which causes the first impulsive sound when the sheet is picked up;

a sheet feeding unit configured to feed the picked-up sheet to a conveying path, the sheet feed including the second sound generating unit which causes the second impulsive sound when the sheet is fed;

a conveying unit configured to convey the fed sheet along the conveying path;

an aligning unit configured to align the conveyed sheet and supply the aligned sheet, the aligning unit including the third sound generating unit which causes the third impulsive sound when the sheet is aligned; and a drive unit configured to drive the pickup unit, the sheet feeding unit, the conveying unit, and the aligning unit.

11. The apparatus according to claim 10, further comprising:

a sorting unit configured to select the first time interval T so as to convey the sheet, select first, second, and third times as the times determined based on the second time interval so that the first, second, and third impulsive sounds appear rhythmically in the first time interval, and sort appearances of the first, second, and third impulsive sounds to the first, second, and third times; and a drive command unit configured to provide a drive command to the drive unit based on a drive command program to cause the drive unit to convey the sheet along the conveying path, wherein the drive command includes a command to specify a speed of conveying the sheet and to cause the first, second, and third sound generating units to cause the first, second, and third impulsive sounds at the first, second, and third times.

12. The apparatus according to claim 11, wherein the first, second, and third impulsive sounds correspond to impulsive sounds caused when the first, second, and third sound generating units are started or impulsive sounds caused when the first, second, and third sound generating units are stopped.

13. The apparatus according to claim 11, wherein the pickup unit includes a housing unit configured to house sheets including the sheet, a sending unit configured to send the sheet from the housing unit, and a driving force transmission unit configured to transmit the driving force to the sending unit, and the first impulsive sound corresponds to one of a contact sound attendant on contact between the sending unit and the sheet and a mechanical sound attendant on connection or disconnection in the power transmission unit.

14. The apparatus according to claim 11, wherein the aligning unit includes a registration roller to correct an inclination of the sheet by causing the sheet to collide and the third impulsive sound is caused by contact of the sheet with the registration roller.

15. The apparatus according to claim 1, further comprising:

a drive unit configured to drive the conveying mechanism;

a sorting unit configured to select the first time interval T so as to convey the sheet, select first, second, and third times as the time determined based on the second time interval so that first, second, and third impulsive sounds appear in the first time interval T, and sort appearances of the first, second, and third impulsive sounds to the first, second, and third times, wherein the plurality of sound sources include first, second, and third sound generating units which generate the first, second, and third impulsive sounds as the plurality of element sounds respectively; and a drive command unit configured to provide a drive command to the drive unit to cause the drive unit to convey the sheet, wherein the drive command include a command to specify a speed of conveying the sheet and to cause the first, second, and third sound generating units to cause the first, second, and third impulsive sounds at the first, second, and third times.

16. The apparatus according to claim 15, further comprising a setting unit configured to set the first time interval T and the first, second, and third times.

17. The apparatus according to claim 15, wherein the conveying mechanism comprises a driving force transmission unit including parts to transmit a driving force, and at least one of the first, second, and third sound generating units includes at least one of impulsive sounds caused when the driving force transmission unit is connected and disconnected, an impulsive sound caused by contact with the sheet, and an impulsive sound caused by the contact inside the parts of the driving force transmission unit.

18. The apparatus according to claim 1, further comprising an interface configured to input the division number, wherein the control unit adjusts a conveyance speed at which the sheet is conveyed in accordance with the specified division number.

19. The apparatus according to claim 1, wherein the control unit configured to set the division number n in accordance with a conveyance speed at which the sheet is conveyed.

* * * * *